US005343280A

United States Patent [19]

Hirabayashi et al.

[11] Patent Number: 5,343,280

[45] Date of Patent: Aug. 30, 1994

[54] IMAGE FIXING APPARATUS

[75] Inventors: Hiromitsu Hirabayashi, Yokohama; Kensaku Kusaka, Kawasaki; Atsushi Arai, Kasukabe; Yoshiaki Takayanagi, Yokohama, all of Japan

[73] Assignee: Canon Kabushiki Kaisha, Tokyo, Japan

[21] Appl. No.: 135,130

[22] Filed: Oct. 12, 1993

Related U.S. Application Data

[60] Continuation of Ser. No. 847,323, Mar. 6, 1992, which is a division of Ser. No. 668,333, Mar. 14, 1991, Pat. No. 5,149,941, which is a continuation of Ser. No. 206,767, Jun. 15, 1988, abandoned.

[30] Foreign Application Priority Data

| | | | |
|---|---|---|---|
| Jun. 16, 1987 | [JP] | Japan | 62-147884 |
| Jan. 22, 1988 | [JP] | Japan | 63-012069 |
| Apr. 15, 1988 | [JP] | Japan | 63-091267 |
| Apr. 15, 1988 | [JP] | Japan | 63-091268 |
| Apr. 15, 1988 | [JP] | Japan | 63-091269 |
| Apr. 15, 1988 | [JP] | Japan | 63-091270 |
| Apr. 15, 1988 | [JP] | Japan | 63-091271 |
| Apr. 15, 1988 | [JP] | Japan | 63-091272 |
| Apr. 15, 1988 | [JP] | Japan | 63-091274 |
| May 6, 1988 | [JP] | Japan | 63-109192 |
| May 6, 1988 | [JP] | Japan | 63-109193 |

[51] Int. Cl.[5] ..... G03G 15/20

[52] U.S. Cl. ..... 355/285; 219/216; 355/309

[58] Field of Search ..... 219/216, 388; 432/60, 432/62; 355/289, 290, 295, 285, 309, 311, 282

[56] References Cited

U.S. PATENT DOCUMENTS

| | | | |
|---|---|---|---|
| 3,578,797 | 5/1971 | Hodges | 263/3 |
| 3,667,742 | 6/1972 | Kamola | 263/6 E |
| 3,810,735 | 5/1974 | Moser | 432/59 |
| 3,811,828 | 5/1974 | Ohta et al. | 432/227 |
| 3,948,215 | 4/1976 | Namiki | 118/60 |
| 4,161,644 | 7/1979 | Yanagawa et al. | 219/216 |
| 4,566,779 | 1/1986 | Coli et al. . | |
| 4,780,742 | 10/1988 | Takahashi et al. | 219/216 |
| 4,998,121 | 3/1991 | Koh et al. | 355/206 |
| 5,043,763 | 8/1991 | Koh et al. | 355/206 |

FOREIGN PATENT DOCUMENTS 48-94438 3/1972 Japan .

*Primary Examiner*—R. L. Moses

*Attorney, Agent, or Firm*—Fitzpatrick, Cella, Harper & Scinto

[57] ABSTRACT

An image forming apparatus contains an accommodator for accommodating a recording material together with an image forming device for forming an image on that recording material supplied from the accommodator. A fixing apparatus receives the imaged recording material and includes a heat generating resistor layer, a protection layer covering the heat generating resistor layer and a sheet movable with the recording material in sliding contact with the protection layer, wherein the image is heated by heater through the sheet. A position detector detects the position of the recording material and the power supply to the heat generating resistor layer is started in accordance with the output of the position detector.

2 Claims, 25 Drawing Sheets

IMAGE FIXING APPARATUS

This application is a continuation of application Ser. No. 07/847,323 filed Mar. 6, 1992; which is a divisional of application Ser. No. 07/668,333 filed on Mar. 14, 1991, now U.S. Pat. No. 5,149,941 issued Sep. 22, 1992; which is a continuation of application Ser. No. 07/206,767 filed Jun. 15, 1988, now abandoned.

FIELD OF THE INVENTION AND RELATED ART

The present invention relates to an image fixing apparatus for fixing an image on a recording medium by applying at least heat to an unfixed toner image formed on an image recording or carrying material with heat-fusible toner, more particularly to an image fixing apparatus of such a type wherein heat is applied to the unfixed toner image through a sheet moving together with the recording material.

As for image fixing machines of the type wherein a toner image is fixed by heat, a heating roller type fixing system is widely used wherein an image recording material carrying an unfixed toner image is passed through a nip formed between a heating roller of a temperature maintained at a predetermined level and a pressing roller having an elastic layer for pressing the recording material to the heating roller. However, this system involves a problem that a heat capacity of the heating roller or a heating element has to be large, since the temperature of the heating roller has to be maintained at an optimum level in order to prevent toner offset, which is an unintended transfer of the toner to the heating roller. If the heat capacity of the heating roller is small, the heating roller temperature is easily shifted to a higher or lower temperature in response to reception of the recording material or other external disturbance in terms of heat supply from a heat generating element. If it is shifted to a lower temperature, the toner is soften or fused insufficiently with the result of insufficient image fixing and/or low temperature offset. If, on the other hand, it is shifted to a high temperature, the toner is completely fused with the result of lower toner coagulation force, and therefore, occurrence of a high temperature offset.

When the heat capacity is large as required for the reasons described above, the warm-up period, that is, the time period required for the heating roller to reach a predetermined temperature, is long. Usually, the offset is not completely prevented even if the heat capacity is made large, and therefore, a parting agent such as a silicone oil is applied to the heating roller.

As a proposal for preventing the offset, U.S. Pat. No. 3,578,797 and Japanese Laid-Open Patent Application No. 94438/1973 disclose that a web or a belt is interposed between an unfixed toner and a heating roller for applying the heat, and the image fixing operation is performed through the following steps:

(1) The toner image is heated by a heating element to a fusing temperature to fuse the toner;
(2) After fusing, the toner is cooled to provide a relatively higher viscosity of the toner; and
(3) The web is removed after the toner deposition tendency is lowered by the cooling.

Since the web is removed from the toner after the toner is cooled in this method, the high temperature offset is eliminated, thus increasing the latitude for the fixing temperature.

However, since the toner is heated by a heating roller having a heater therein, and therefore, having a large heat capacity, the problem of long warmup period is still not solved. In addition, the heat radiation inside an image forming apparatus with which the fixing apparatus is used is large, with the result of a high temperature within the apparatus.

As another problem with the fixing apparatus disclosed in U.S. Pat. No. 3,578,797, the recording member is heated without being press-contacted to the heating roller, and therefore, the efficiency of the heat transfer from the heating roller to the toner is low, and in addition, the heat transfer tends to become non-uniform.

In the above-mentioned Japanese Laid-Open Patent Application No. 94438/1973, the toner image is heated both from the upside and downside. In order to apply heat to the toner image from the side opposite to the side thereof carrying the toner image, it is required that the image carrying material is first heated to a sufficient extent, which requires large energy. In addition, in the cooling step, the image carrying material having been heated to a high temperature for the purpose of heating the toner image, has to be cooled sufficiently in order to allow the separation of the web, so that a forced cooling means is inevitable, with the result that the energy is consumed wastefully.

As described, even though proposals have been made wherein the toner is heated and then cooled before the separation, so that the high temperature offset is prevented, they still involve the above-described problems, and therefore, they have not been put into practice.

SUMMARY OF THE INVENTION

Accordingly, it is a principal object of the present invention to provide an image fixing apparatus wherein a high temperature offset is prevented, and the energy consumption is low.

It is another object of the present invention to provide an image fixing apparatus wherein after the toner is heated, it is immediately cooled.

It is a further object of the present invention to provide an image fixing apparatus wherein a temperature rise of an image carrying material or an image recording material is decreased, and the toner can still be fused efficiently.

It is a yet further object of the present invention to provide an image fixing apparatus by which a temperature of an image carrying material or recording material is so-called that an operator can easily handle, even immediately after the material is discharged from the apparatus.

It is a still further object of the present invention to provide an image fixing apparatus wherein a heater is disposed outside rollers.

It is a still further object of the present invention to provide an image fixing apparatus wherein a web to be disposed between a toner image and an heating element is effectively prevented from being electrically charged.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
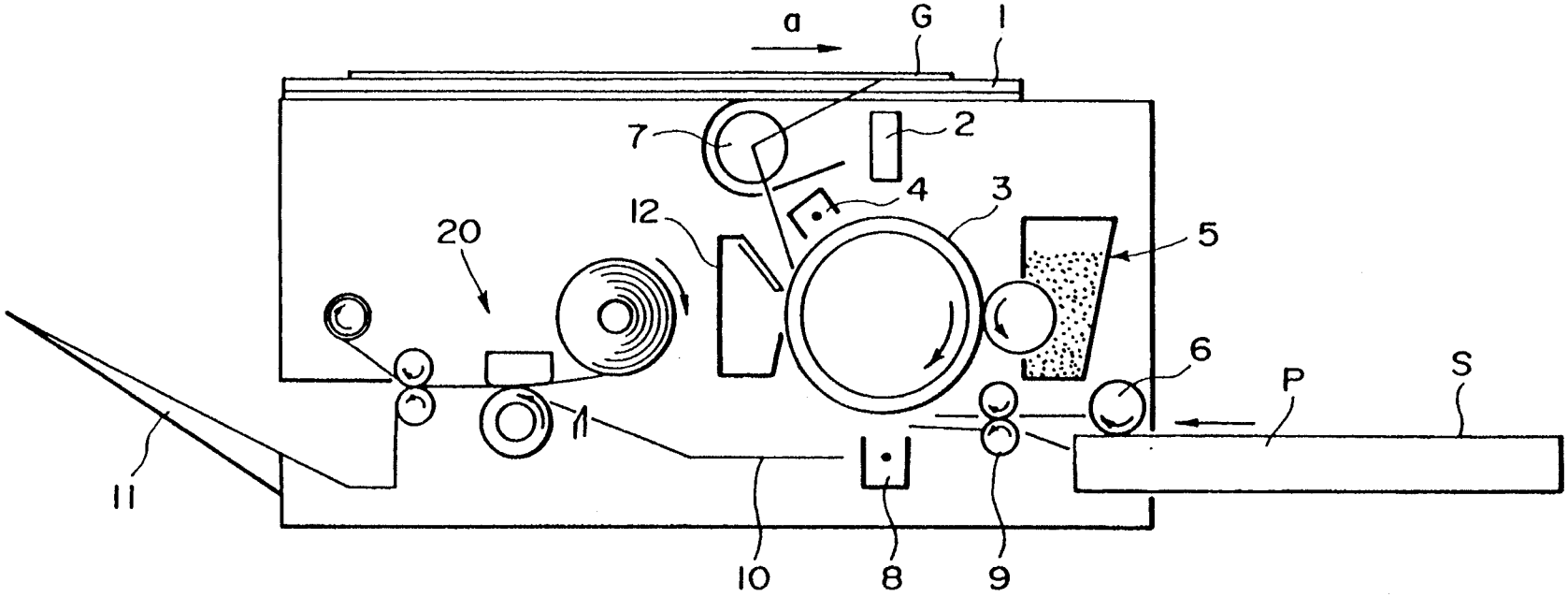
FIG. 1 is a sectional view of an electrophotographic copying apparatus incorporating an image fixing apparatus according to an embodiment of the present invention.

The preferred embodiments of the present invention will be described, referring to the drawings, in which like reference numerals have been used throughout to designate elements having corresponding functions.

Referring now to FIG. 1, there is shown an image fixing apparatus used with an electrophotographic copying apparatus which is an exemplary image forming apparatus with which an image fixing apparatus according to the present invention is usable.

The electrophotographic copying apparatus comprises an original carriage having a transparent member such as glass or the like and reciprocally movable to scan an original when it is moved in a direction indicated by an arrow a. Directly below the original carriage, there is an array 2 of small diameter and short focus imaging elements. An original G to be copied placed on the original carriage 1 is illuminated by an illuminating lamp 7, and the reflected light image of the original is projected through a slit onto a photosensitive drum 3 by the array 2. The photosensitive drum 3 is rotatable in a direction b. The photosensitive member 3 is coated with zinc oxide photosensitive layer or an organic semiconductive photosensitive layer 3*a* or the like. The photosensitive layer 3*a* is charged uniformly by a charger 4. The photosensitive drum 3 having been uniformly charged by the charger 4 is exposed to the image light through the lens array 2, so that an electrostatic latent image is formed. The electrostatic latent image is visualized by a developing devices with a toner containing resin material or the like which has a property of being softened or fused if heated.

On the other hand, recording sheets P are accommodated in a cassette S, and are fed one by one by a pick-up roller 6 and a pair of registration rollers 9 which are press-contacted to each other and are rotated in timed relation with an image formed on the photo-sensitive drum 3, to an image transfer station. In the image transfer station, the toner image formed on the photosensitive drum 3 is transferred onto the sheet P by a transfer discharger 8. Thereafter, the sheet P is separated from the photosensitive drum 3 by a known separating means, and is transported along a conveyance guide 10 to an image fixing apparatus 20, wherein the toner image is fixed on the sheet P, using heat. Subsequently, the sheet P is discharged onto a tray 11.

After the toner image is transferred, the residual toner remaining on the photosensitive drum 3 is removed by a cleaner 12. After the cleaning, the photosensitive drum 3 is illuminated by a lamp 7, so that residual charge remaining thereon is removed, by which the photosensitive drum 3 is prepared for the next image formation.

Figure 2:
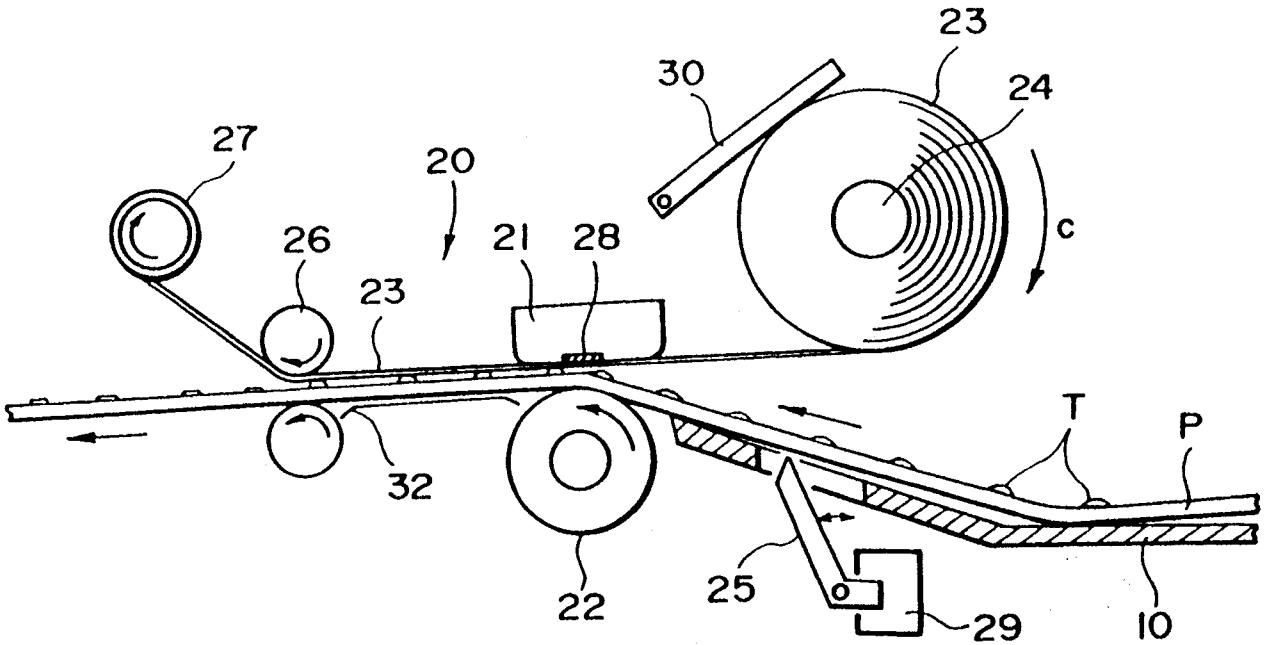
FIG. 2 is a sectional view of an image fixing apparatus according to an embodiment of the present invention.

Referring to FIG. 2, there is shown the image fixing apparatus 20 in an enlarged scale and in a cross-section. The fixing apparatus 20 comprises a heat generating-element 21 which includes an electrically insulative and heat durable base member made of alumina or the like or a compound material containing it, and which includes a heat generating layer 28 which is mounted on the bottom surface of the base member and which has a width of 160 microns and a length (measured along a direction perpendicular to the sheet of the drawing) of 216 mm and which is made of, for example, $Ta_2N$ or the like. The heat generating member 21 is disposed at a fixed position between the supply reel 24 and the take-up reel 27, particularly between the supply reel 24 and the separation roller 26. The heat generating layer 28 is in the form of a line or a stripe. The surface of the heat generating layer 28 is coated with a protection layer made of, for example, $Ta_2O_5$ functioning as a protection from sliding movement. A bottom surface of the heat generating member 21 is smooth, and the upstream and downstream ends are rounded to provide a smooth sliding contact with a heat resistive sheet 23.

The heat resistive heat 23 contains as a base material polyester. The sheet 23 has been treated to provide a heat resistive property. It has a thickness of approximately 9 microns, for example. The sheet 23 is wound around a supply reel 24 for supply in a direction C. The heat resistive sheet 23 is contacted to the surface of the heat generating element 21 and is wound up on a take-up reel 27 by way of a separation roller 26 having a large curvature (small diameter).

The fixing apparatus comprises a pressing roller 22 for providing press-contact between the heat generating elements 28 and the heat resistive sheet 23 and between the heat resistive sheet 23 and the toner image. The pressing roller 22 comprises a core member made of metal or the like and an elastic layer made of a silicone rubber or the like. It is driven by a driving source (not shown) to press-contact the transfer material P carrying an unfixed toner image T and conveyed along a conveying guide 10, to the heat generating element 21 through a heat resistive sheet 23 moving in the same direction and at the same speed as the transfer material P. The conveying speed provided by the pressing roller 22 is preferably substantially equal to the conveying speed in the image forming apparatus, and the speed of the heat resistive sheet 23 is determined in accordance therewith.

In the apparatus of this embodiment having the structure described above, the toner image formed by a heat fusible toner on the transfer sheet P is heated by the heat generating element 21 through the heat resistive sheet 23, by which at least the surface portion is completely softened and fused. After the toner image is moved away from the heat generating element 21 and before it reaches the separation roller 26, the heat of the toner image is spontaneously radiated so as to be cooled and solidified, and by passing between the separation rollers 26 having a large curvature, the heat resistive sheet 23 is separated from the transfer sheet P. Thus, since the toner T is once softened and fused, and then is solidified, the coagulation force of the toner is very large, whereby the toner particles behave as a mass. Also, since the toner is pressed by the pressing roller 22 while it is softened and fused by heat, the toner image T penetrates into the surface part of the transfer sheet P, and is cooled and solidified therein. Therefore, the toner is not offset to the heat resistive sheet 23, and is fixed on the transfer material P.

The heat generating layer 28 and the heat generating element 21 may be small in size, and therefore, the heat capacity thereof may be small. For this reason, it is not required to generate the heat beforehand, so that the power consumption during non-image forming period, and also the temperature rise in the apparatus can be prevented.

In this embodiment, it is possible to use as the heat resistive sheet 23 a polyester sheet which is thin and inexpensive and which has been treated for heat resistive property, so that the heat resistive sheet 23*b* may be stored in the form of a roll as shown in FIG. 2, which is replaced with a fresh roll after it is used up. In this structure, a roll of a sheet having a predetermined length is set on a supply reel shaft 24, and is extended between the sheet generating element 21 and a pressing roller 22 and between separation rollers 26, and then the leading edge of the sheet is fixed on the take-up reel shaft 27. Where this system is adopted, it is preferable that the remaining amount of the heat resistive sheet on the supply reel 24 is detected by a heat resistive sheet sensor arm 30 and an unshown sensor, and that when the remaining amount becomes small, an warning is produced by display or sound to the user to promote replenishment of the heat resistive sheet.

Figure 3:
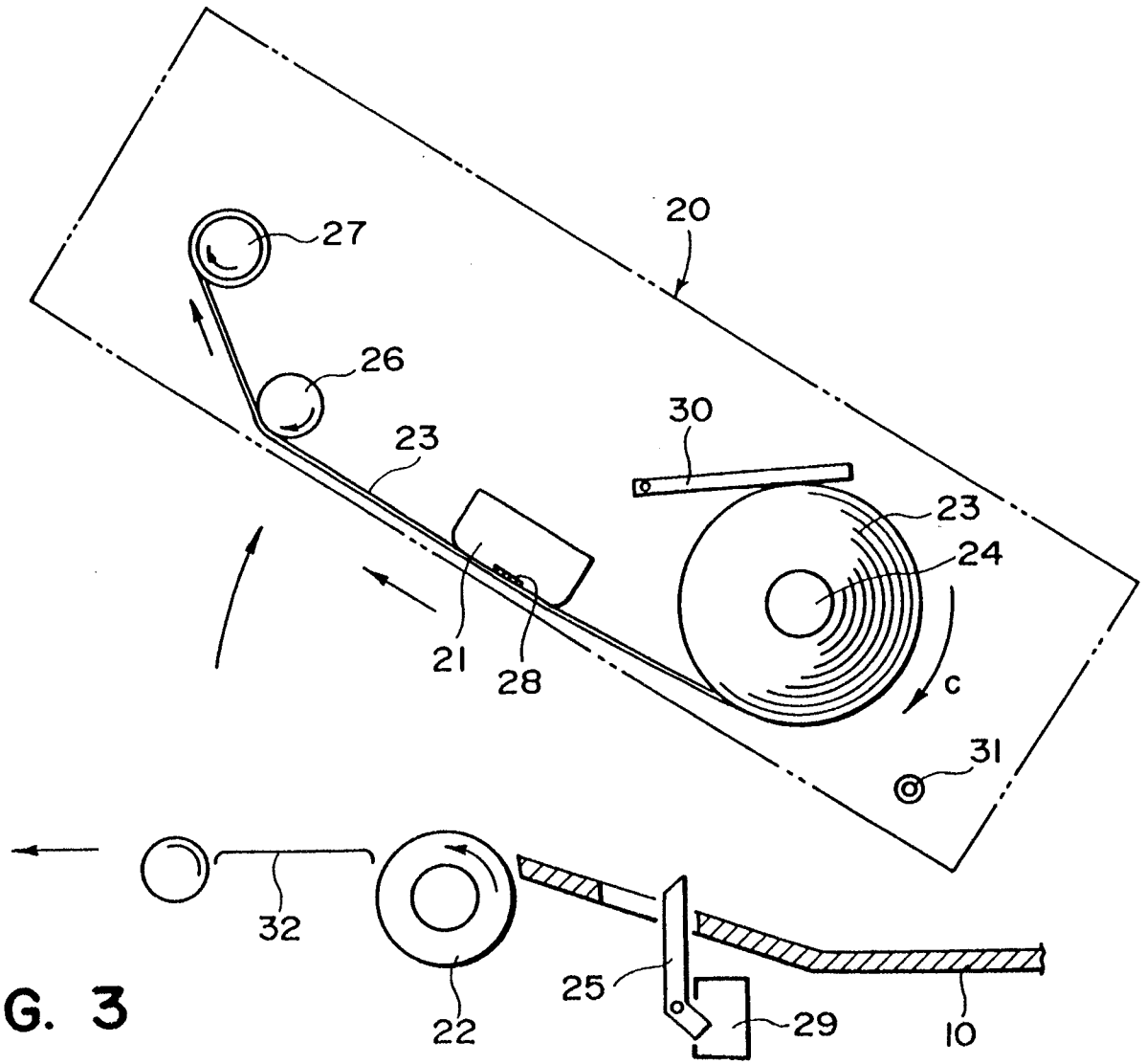
FIG. 3 is a sectional view of the image fixing apparatus of FIG. 2 wherein a part thereof is opened.

Referring to FIG. 3, it is preferable to make the fixing apparatus openable by rotation of the upper part thereof about a shaft 31, by which separation is made between the heat generating element 21 and the pressing roller 22 and between the separation rollers to facilitate the heat resistive sheet replenishing operation. According to this embodiment wherein when the heat resistive sheet is entirely taken up, a new roll of the sheet is used, the thickness of the sheet can be reduced without particular consideration to the loss of the durability of the heat resistive sheet, and for this reason, the heat capacity of the sheet itself can be reduced, and therefore, the power consumption can be reduced.

As described hereinbefore, the high temperature offset to the heat resistive sheet does not occur in this embodiment, the taken-up heat resistive sheet can be reused if the thermal deformation or deterioration of the sheet is not significant. In this case, the sheet can be rewound for reuse, or otherwise, the take-up reel and the supply reel may be exchanged, by which the roll of the sheet can be used a plurality of times.

In this embodiment, a pair of separation rollers 26 is used, by which sufficient toner image cooling time to the separation rollers 26 while the toner image T is being pressed, can be made sufficiently large. In addition, since the curvature of the separation rollers 26, particularly the separation roller contacted to the heat resistive sheet 23 is large enough to make easy the separation between the heat resistive sheet 23 and the transfer sheet P. By those effects, the toner offset at the separating position can be further prevented. However, in the case where the heat capacities of the heat generating layer 28 and the heat resistive sheet 23 are sufficiently small, and where the image fixing speed is small enough, the separation rollers 26 may be omitted since the toner image T is cooled in a short range after the transfer sheet P passes by the heat generating layer 28 so that the offset can be effectively prevented even without them. What is required is only to separate the heat resistive sheet and the transfer sheet after the toner image is once softened and fused and then cooled and solidified.

The pressing roller 22 has a rubber layer in this embodiment so that the heat capacity is large, and therefore, it is difficult to raise the temperature thereof. Also, it has a sufficiently large diameter. Accordingly, the surface of the pressing roller 22 is not so heated .as up to higher than the toner fusing temperature. This provides a cooling effect to the back side of the transfer sheet, thus promoting the toner cooling after the fusing thereof. Also, the transfer sheet discharged from the image fixing apparatus is not so hot as to allow confortable handling of the sheet even immediately after it is discharged therefrom.

The description will be made as to power supply to the heat generating element. The heat capacity of the heat generating layer 28 of the heat generating element 21 is energized intermittently, more particularly, pulsewisely. Since the heat capacity of the heat generating layer 28 is so small that it is instantaneously heated up to about 260° C. The energization and de-energization of the heat generating surface 28 are timed on the basis of an output of a transfer sheet detecting sensor 29 interrelated with a transfer sheet detecting lever 25 which detects the leading and trailing edges of the transfer sheet P. Alternatively, the timing of energization and deenergization may be controlled on the basis of a transfer sheet detection by a sheet sensor provided on the image forming apparatus.

Experiments using the image fixing apparatus according to this embodiment will be described. A toner image T was formed with a wax toner for an electrophotographic copying machine PPC PC-30 available from Canon Kabushiki Kaisha, Japan. The fixing speed was approximately 15 mm/sec. The heating layer 28 was energized for 2 ms for every 10 ms so as to provide heat of approximately 2000 W.S per one A4 size sheet. It was confirmed that the fixed image was practically without problem. By the energization, the heat generating layer 28 is heated up to approximately 260° C. Since the heat capacity is small, the temperature lowers enough during de-energization period of 8 ms (=10 ms−2 ms). Therefore, the waiting period for heating up the heating element is eliminated. Since the thermal energy required for the image fixing is supplied intermittently, more particularly, pulsewisely, the heat generating layer having a small heat capacity, and therefore, exhibiting a quick rise can be easily heated to substantially the same temperature level, periodically. When the image fixing is performed continuously, the pulse duration of energization may be gradually decreased, by which the temperature of the heat generating layer can be prevented from shifting to an extremely high temperature. In this embodiment, the temperature of the toner image T exceeds the temperature which is conventionally said to be a limit for preventing the high temperature offset, even though it is for a very short period. However, since the heat resistive sheet 23 and the transfer sheet P are separated after the toner is sufficiently cooled down and solidified, the offset does not result. The wax of the toner which is a major component thereof in this embodiment has a fusing point of approximately 80° C., and the viscosity thereof when it is fused is low enough.

Therefore, when the toner is heated by a heating element having a temperature of approximately 260° C., a conventional heat fixing apparatus has been such that the fused toner is penetrated into the transfer material too much so that the image is smeared, or the image is penetrated even to the backside of the sheet. This has been an obstruction to decreasing the fusing point of the toner. According to this embodiment, the toner is not penetrated too much, because the heat capacity of the heat generating layer 28 is very small, and because the heating period is very short, by which only the surface part of the transfer sheet is heated for only a short period. This is further enhanced by the temperature of the surface of the pressing roller which is lower than the toner fusing temperature.

Figure 4:
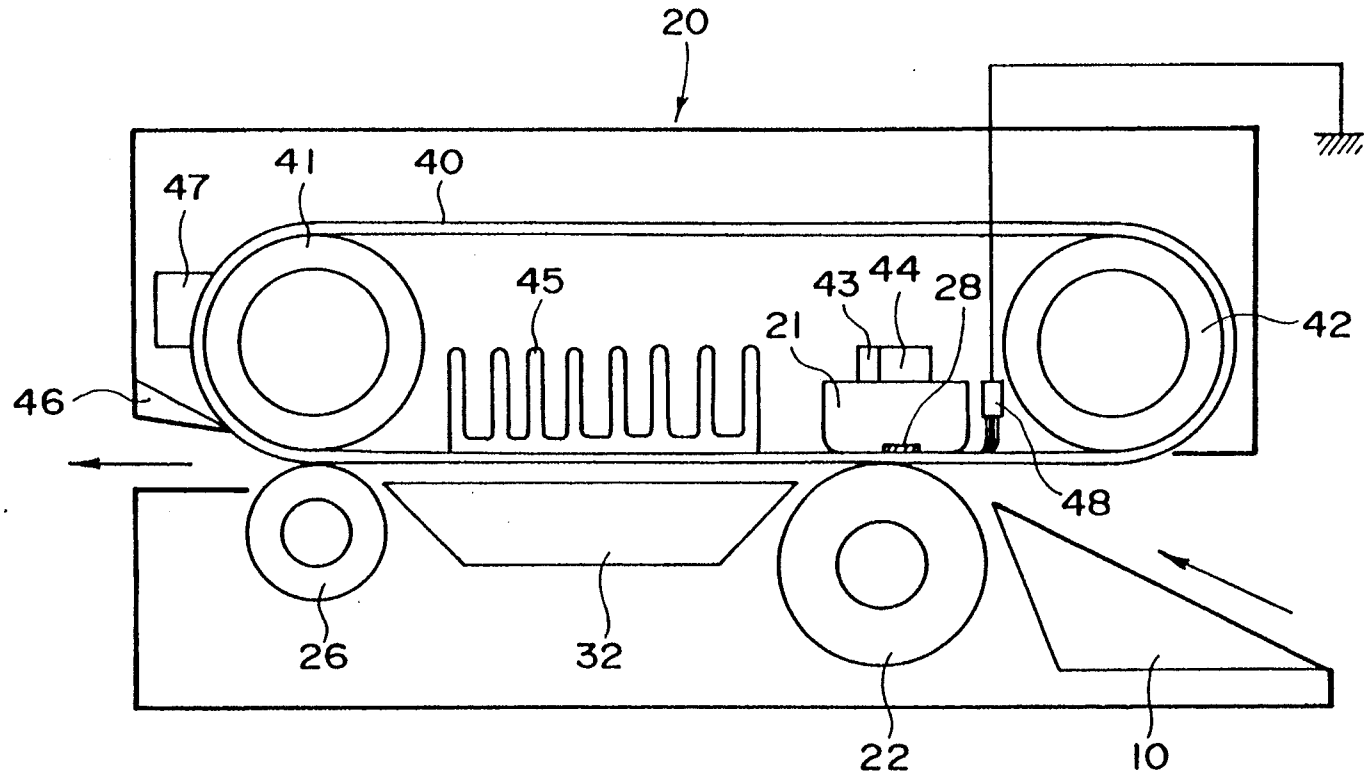
FIG. 4 is a sectional view of an image fixing apparatus according to another embodiment of the present invention.

Referring to FIG. 4, another embodiment of the present invention will be described. In the Figure the same reference numerals are assigned to the elements having corresponding functions, by which detailed description thereof is omitted for the sake of simplicity.

In this embodiment a heat resistive sheet in the form of an endless web is used in place of the non-endless heat resistive sheet 23 in the foregoing embodiment. The heat resistive sheet 40 is repeatedly heated and is repeatedly contacted to the toner image T. In consideration of the repetitive use, the endless sheet is made of PFA resin (perfluoroalkoxy resin) having a thickness of 30 microns which has a good parting property and heat resistivity. The heat resistive sheet 40 is driven by a sheet driving shaft 41 so as to provide a peripheral speed, which is the same as the conveying speed of the transfer material P. The heat resistive sheet 40 is stretched between the driving shaft 41 and an idler roller 42 which is urged to provide tension to the sheet, while allowing revolution of the endless sheet 23.

The heat generating element 21 is provided with a temperature detecting element 43 for detecting the temperature of the base member. Further, it is provided with a temperature fuse or thermostat as a safety device 44 to prevent overheating.

More particularly, when the base member is overheated, the safety device 44 is actuated to shut off the energy supply to the heat generating layer 28.

The energy supply timing to the heat generating layer in this embodiment is controlled in accordance with a signal produced in an image forming apparatus. The image fixing speed, and the image forming speed is 50 mm/sec, which is higher than that of the foregoing embodiment. In view of this, the width of the heat generating layer 28 (heating width) is 300 microns which is larger than that of the foregoing embodiment. The energy supply period was 1.25 ms per 5 ms so as to provide approximately 2400 W.S per one A4 size sheet. The maximum temperature of the heat generating layer is about 300° C. The temperature rise (heat accumulation) of the heat generating element 21 itself is larger than that in the foregoing embodiment, since the electric power density applied to the heat generating layer 28 is larger and also since the heat is applied for a shorter period. In consideration of this, the pulse width of energization is controlled in accordance with an output of the temperature detecting element 43 mounted to the heat generating layer 28. More particularly, when the temperature of the base member of the heat generating element 21 is high, the energization pulse width is decreased to prevent an extreme temperature rise of the heat generating element. The control of the energization pulse will be described hereinafter.

Since the temperature of the heat generating layer 28 and the total thermal energy applied to one transfer sheet are increased to cope with the increased image fixing speed, the time period required for cooling the toner to a sufficient extent is increased, and therefore a longer distance is required to a position at which the sheet and the transfer sheet are separated.

To solve this problem, a radiating plate 45 of aluminum is disposed in contact with the heat resistive sheet 40 between the heat generating elements 21 and the separation roller 26. By the provision of the cooling means before the separation between the heat resistive sheet 40 and the transfer sheet P, the necessity for the long distance between the heat generating element 21 and the separating position can be eliminated without giving up the sufficient cooling of the toner before the separation.

A separation pawl or pawls 46 are disposed as shown in FIG. 4 to assure the separation of the transfer material P. Further, in order to remove foreign matters such as paper dust or the like deposited on the heat resistive sheet 40, a cleaning pad 47 made of felt is contacted to the heat resistive sheet 40. The felt pad 47 may be impregnated with a small amount of parting agent, such as silicone oil to improve the parting property of the heat resistive sheet 40. Since this embodiment uses the heat resistive sheet 40 made of PFA resin which is insulative, the heat resistive sheet tends to be electrostatically charged, by which the toner image can be disturbed. To obviate this problem, a discharge brush 48 which is grounded is used to discharge the heat resistive sheet 40. Here, it is possible that the brush is supplied with a bias voltage rather than being grounded to positively charge the heat resistive belt within the limit of not disturbing the toner image. It is preferable that conductive particles or fibers such as carbon black or the like are added in the PFA resin to prevent the electrostatic disturbance to the image. The same means for the discharging or for providing the conductivity may be used for the pressing roller. As an another alternative, anti-electrification agent may be applied or added thereto.

As described hereinbefore, this embodiment uses an endless heat resistive sheet. The heat generating element 21 is disposed inside the endless sheet 40 and between the supply and take-up reels 41 and 42. It is preferable that the heat generating element 21 is disposed upstream of the central position between the reels to assure the distance for cooling the fused toner.

As for the position of the discharging brush 48, it is preferably disposed immediately upstream of the heat generating element 21, that is, between the heat generating element 21 and the roller 42. By doing so, the charge produced by separation of the sheet 40 from the roller 42 is also removed. It is further preferably positioned upstream of the position where the transfer material and the heat resistive sheet are contacted, since then the disturbance to the toner image by the electrostatic charge can be assuredly prevented.

In this embodiment, the high processing speed results in the maximum power consumption of as large as approximately 1600 W. In consideration of this, the heat generating layer may be divided in the longitudinal direction into four elements which are sequentially energized, by which the maximum power consumption is reduced to 400 W.

It has been described hereinbefore that the toner cooling effect from the backside of the transfer sheet can be provided by using a sufficiently large heat capacity and large diameter of the pressing roller to prevent the surface temperature of the pressing roller at the nip from becoming beyond the toner fusing temperature during the fixing operation.

Figure 5:
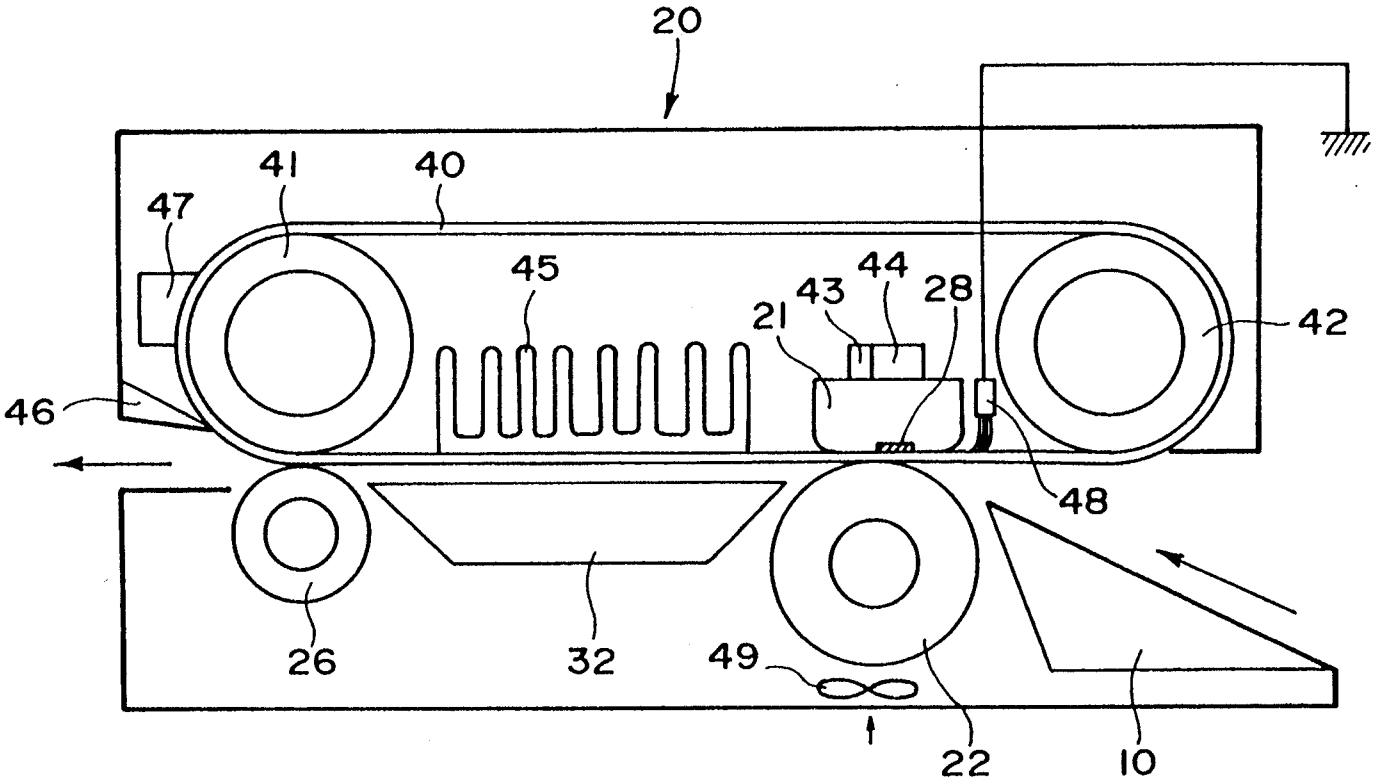
FIG. 5 is a sectional view of an image fixing apparatus according to a further embodiment of the present invention.

Referring to FIG. 5, a further embodiment will be described in which the cooling effect by the pressing roller can be provided even if the heat capacity and the diameter of the pressing roller is small.

In this embodiment, a cooling fan 49 is provided to apply air wind to the pressing roller so as to maintain the surface temperature of the pressing roller at a temperature lower than the toner fusing temperature. By the provision of such a fan, even if the surface temperature of the pressing roller tempolarily rise at the nip, it is lowered during one rotation. It is preferable that the air flow by the cooling fan 49 is directed to the heat resistive sheet 40 to promote the cooling of the toner after the heat generating element 21.

The fact that the surface temperature of the pressing roller is lower than the toner fusing temperature can be confirmed by applying a paint whose color changes at the toner fusing temperature, on the pressing roller surface, or by coating the pressing roller with the toner and then checking the toner after the fixing operation performed.

As described hereinbefore, the heat generating layer 28 is intermittently and pulse-wisely energized. The description will be made as to the energization of the heat generating layer.

Figure 6:
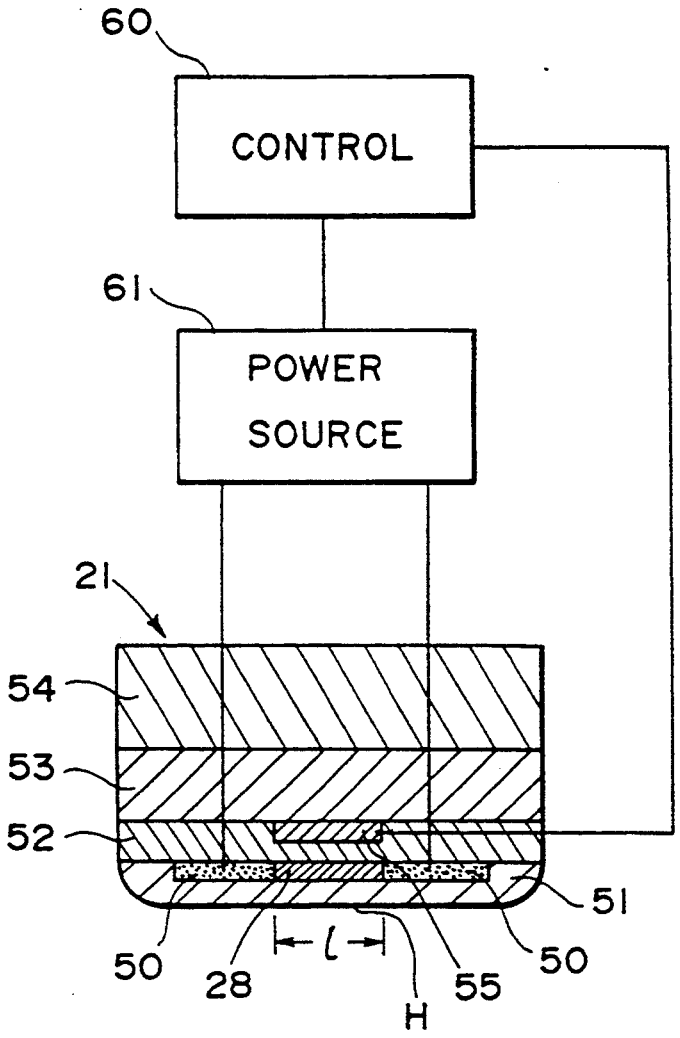
FIG. 6 is a cross-sectional view of a heat generating element according to an embodiment of the present invention.

Referring to FIG. 6, there is shown a preferable heat generating element 21 provided with a temperature detecting element. The heat generating element 21 includes a base layer 54, a heat resistive layer 53 of a heat resistive and low thermal conductivity material on the base layer 54, a thermister 55 functioning as a low heat capacity temperature sensor on the heat resistive layer 53, a thin insulative layer 52 thereon, and electrodes 50 and 50 thereon. Between the electrodes 50 and 50, a heat generating layer 28 having a width l is formed. The surface of the electrodes 50 and 50 and the heat generating layer 28 are coated with a protection layer 51.

To the electrodes 50 and 50, a power source 61 for supplying power pulses is connected. The power source 61 is connected with a control circuit 60 including a microcomputer for controlling the pulses applied to the electrodes in response to a signal from the thermister 55. The control circuit 60 is effective to control the amount of energy per one pulse of the power source by changing the pulse width so that the maximum temperature detected by the thermister 55 is within the predetermined range.

The thermister 55 involves a response property including a rising delay and falling delay due to the presence of the insulating layer 52 between the heat generating layer 28 and the thermister 55 (the insulative layer 52 provides the same thermal gradient as the protection layer 51). However, the situation is the same with the heating portion H, that is, the surface of the protection layer at the heat generating position 28. Therefore, the envelope covering the minimum values of the outputs of this thermister 55 is substantially the same as the envelope covering the maximum values of the temperatures at the heating position H, and therefore, the thermister 55 substantially detects the actual temperature. This is because of the provision of the insulative layer 52 which provides the same thermal gradient as the heat resistive sheet 40.

If constant power pulses are applied to the electrodes without controlling the applying power, the amount of heat generated exceeds significantly beyond the amount of radiation with the result that the heat generating layer 28 and the heating portion H is extremely heated to a high temperature by which the toner image can be non-uniformly fixed, or the heat generating layer 28 or the heat resistive sheet 40 can be damaged by heat. In order to prevent the extreme temperature rise at the heating position H, the power supply control to the electrodes is also effective.

In FIGS. 4 and 6 embodiments, it should be noted that the temperature of the heat generating layer is detected through an insulative layer having a certain heat insulative property between the heat generating layer and the thermister, rather than directly detecting the temperature of the heat generating layer. When the heat generating layer is energized pulse-wisely, the temperature change is very sharp because the heat capacity of the heat generating layer is very small. It is possible that the thermister is not able to follow the sharp temperature change. In consideration of this, it is preferable that the temperature change is made more or less dull before the temperature detection, by the provision of the insulative layer 52. In the structure shown in FIG. 6, the temperature is detected in the same condition as the surface of the protection layer 51, and therefore preferable.

It is further preferable that the consideration is made also to the heat capacity of the heat resistive sheet 40 so that the detected temperature corresponds to the temperature of the outer surface of the heat resistive sheet 40 at the position where it is contacted to the toner. The thermal states are mainly determined by the heat capacity of the heat resistive sheet 40 rather than the protection layer, since the former has a larger heat capacity.

The power control will be described. Since the pulse heating is employed in these embodiments, the toner is heated only for a short period in the order of miliseconds. The temperature of the heating position H rather than the toner heating period is predominant as to the image fixing performance, and the temperature of the toner layer is increased in accordance with the maximum temperature of the heating position H. Therefore, by controlling the power supply to the electrodes 50 and 50 so that the maximum temperature of the heating portion H is maintained at a temperature $T_{HO}$ during the image fixing process, where $T_{HO}$ is a temperature of the heating position H by which the toner is soften enough to be fixed, sufficient image fixing performance can be provided without consuming wasteful power.

Figure 7:
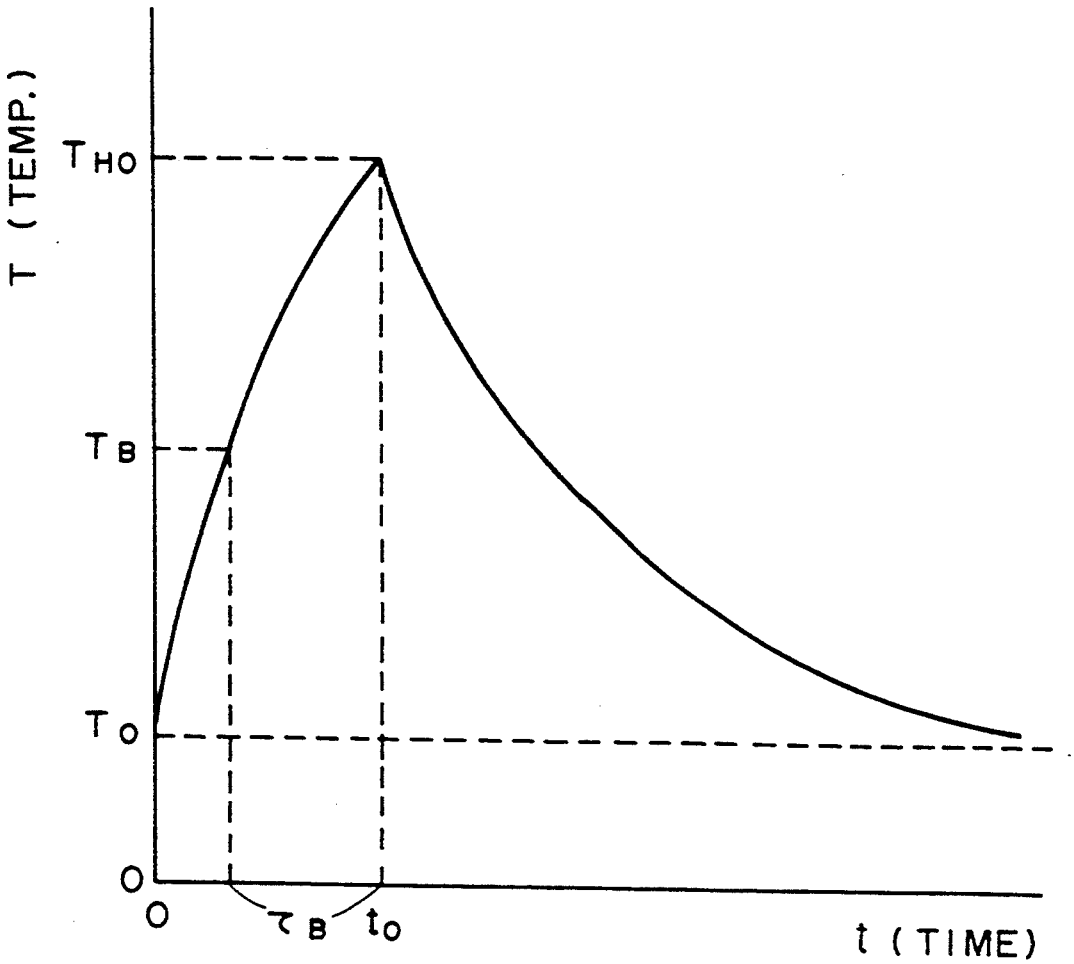
FIGS. 7, 8 and 9 are graphs illustrating temperature control in the embodiments of the present invention.

Among a starting temperature To of the heating position and a fixing temperature $T_{HO}$ of the heating position H to which it reaches by supplying power to the electrode at a constant voltage level V for a period $t_O$, as shown in FIG. 7, there is the following relationship:

$$T_{HO}=To+A\,(1-e^{-B\tau o}) \quad (1)$$

where A and B are coefficients determined on the basis of power supplying conditions to the heat generating layer and heat radiation path from the heating portion H, and are substantially constant if those conditions are within the respective predetermined ranges.

Then, if the temperature of the heating position H is $T_B$, the following is satisfied:

$$T_{HO}=T_B+A\,(1-e^{-B\tau B}) \quad (2)$$

where $\Delta_B$ is a pulse supplying period required for increasing the temperature from $T_B$ to $T_{HO}$.

The equation (2) is expressed as:

$$\tau_B=(1/B)\times 1_n[1/\{1-T_{HO}-T_B)/A\}] \quad (3)$$

As will be understood from the foregoing the coefficients A and B can be determined beforehand by experiments. Therefore, if the temperature $T_{HO}$ is selected to a predetermined temperature, the temperature $T_B$ is measured, and the pulse energy having the pulse width $\tau_B$ is applied, the temperature of the heating portion H can be raised to the fixing temperature $T_{HO}$.

In this embodiment, the energy is supplied to the electrodes 50 and 50 with a sufficiently small duty ratio as described, the temperature of the heating portion H is substantially equal to the temperature detected by the thermister 55 when the temperature of the heating portion H is minimum, that is, immediately before the start of the pulse energy supply. Therefore, next energy supply period is calculated in accordance with the above equation (3) by the control circuit 60 in accordance with the temperature detected by the thermister at this time. The power is supplied from the power source 61 to the electrode 50 and 50 for the calculated period of time.

Figure 8:
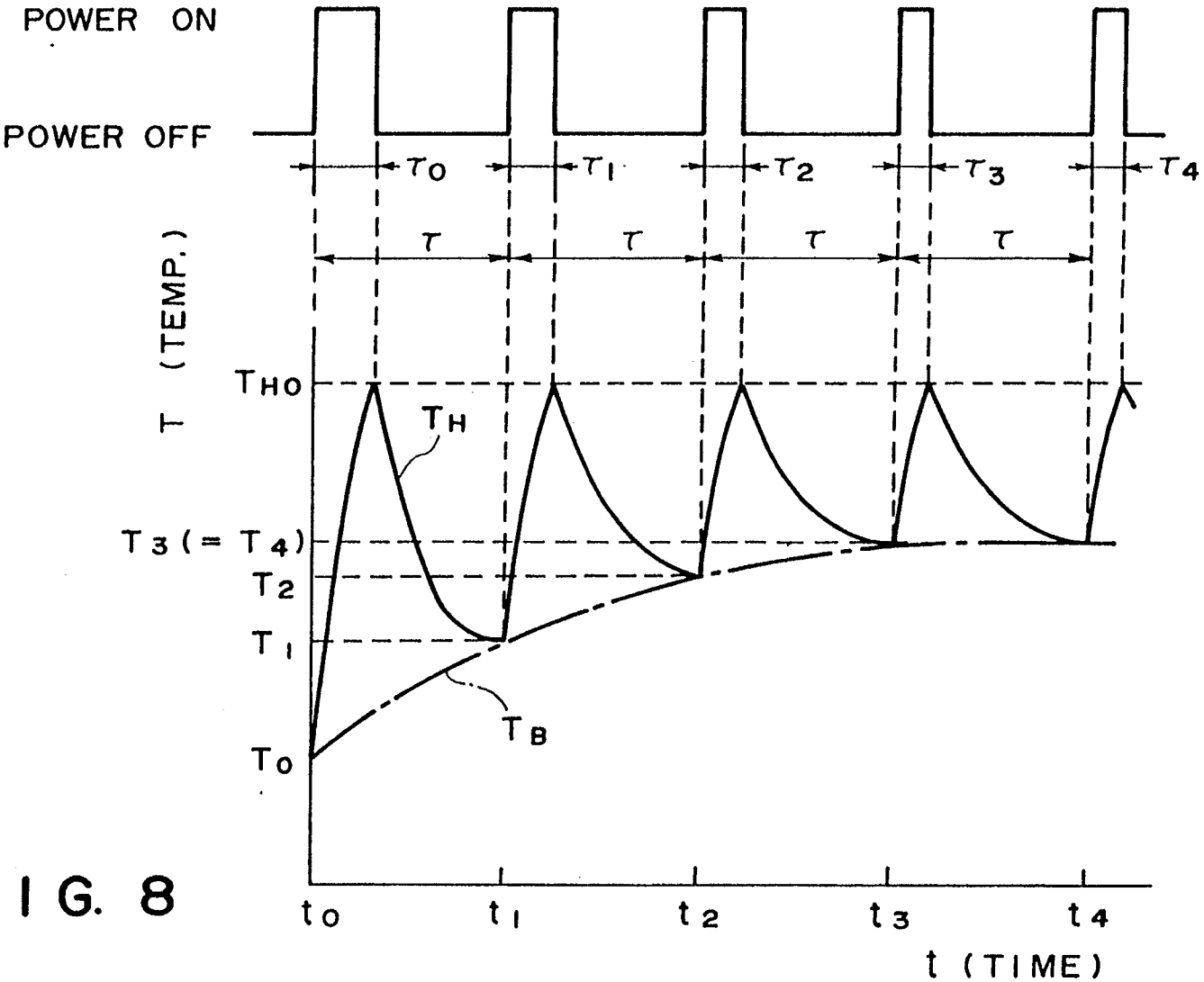

Referring to FIG. 8, the temperature change of the heating portion H with time is shown corresponding to the timing of the pulse energy supply to the electrode 50 and 50. In this embodiment, the voltage of the supply power to the electrodes is constant, and the frequency $(1/\tau)$ of the energy supply pulses is constant. In this Figure, the fixing operation is started at time $t_o$ when the temperature of the heating portion H is To. The temperature of the heating portion H increases by the energy supply having a pulse width $\tau_o$ from the starting temperature To to the fixing temperature $T_{HO}$, and then it decreases during the non-energy-supply period $(\tau-\tau_o)$ which is sufficiently longer than the period $\tau_o$, down to a temperature $T_1$ which is higher than the temperature To. At time $t_1$ which is pulse period $(\tau)$ after the time $t_o$, the second energy supply is effected with a pulse width $\tau_1$ which is shorter than the period $\tau_o$ and which is determined on the basis of the temperature $T_1$, by which the temperature of the heating portion H increases again up to the fixing temperature $T_{HO}$. Similarly, the temperature decreases with the stoppage of the power supply. The subsequent operations are continued in the similar manner. More particularly, for each pulse period $\tau$ after the start of the power supply, the electrodes 50 and 50 are supplied with energy with the pulse width determined by the equation (3) on the basis of the temperature detected by the thermister 55, whereby the maximum temperature of the heating portion H can be maintained at the fixing temperature $T_{HO}$.

Accordingly, the power can be used effectively, and simultaneously therewith, the liability of the thermal deformation of the heat resistive sheet or of damage to the heat generating layer during a continuous image fixing operation can be minimized.

Now, the description will be made as to the relationship between the pulse-wise energy supply and the conveying speed of the transfer material.

Figure 27:
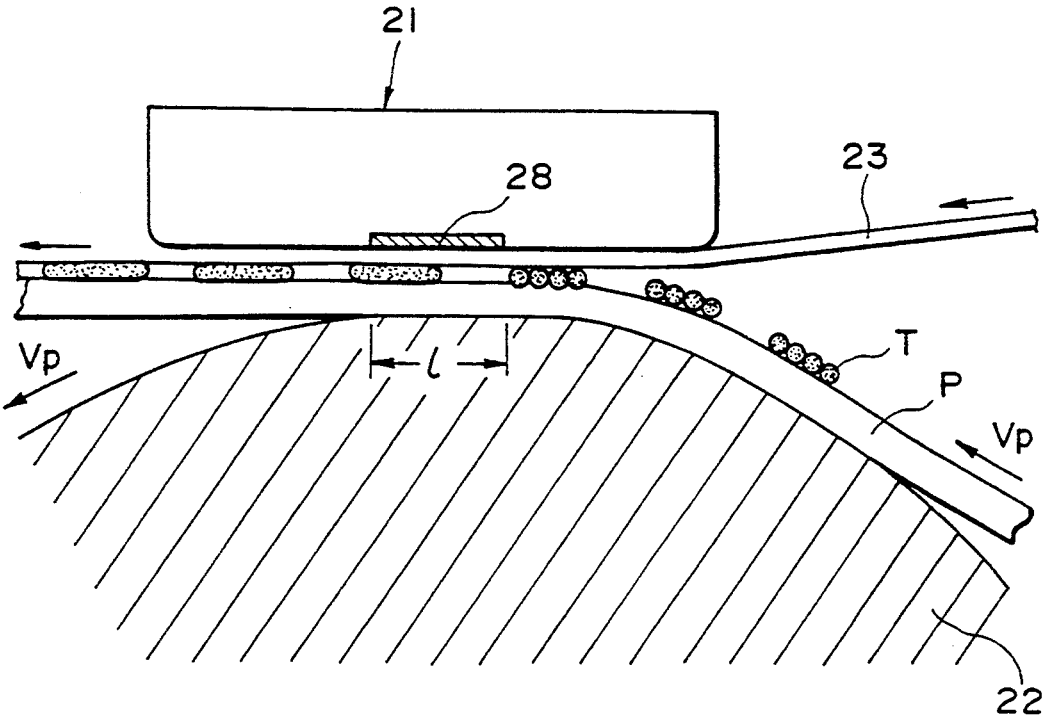
FIG. 27 is a sectional view of a sheet material passing through the fixing apparatus according to the present invention.

As shown in FIG. 27, the toner image T on the transfer sheet P which is being conveyed at a conveying speed of Vp (m/sec) is introduced into the effective fixing width 1 of the heating portion (heat generating layer 28) of the heat generating element 21 together with the image fixing film 23 which is being conveyed correspondingly to the movement of the transfer material.

Figure 28:
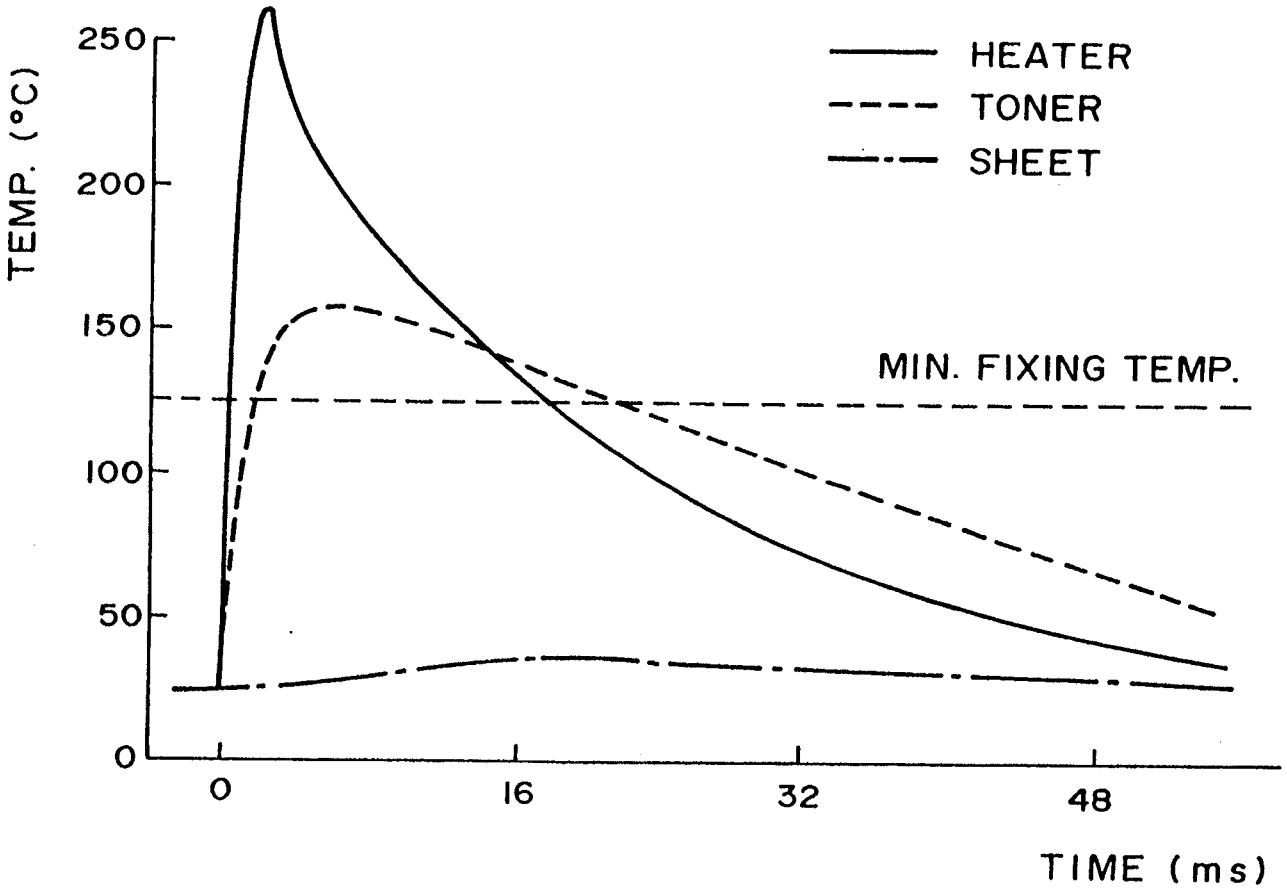
FIG. 28 is a graph showing temperature change with time.

FIG. 28 shows temperature change with time in this embodiment when a toner image having a thickness of 20 microns and formed with toner having a minimum fixing temperature of 125° C. is fixed on a transfer sheet having a thickness of 100 microns with the use of a polyimide film having a thickness of 6 microns as the fixing film. The temperatures at the surface portion of the heating portion, at the inside part of the toner image and at the inside part of the transfer sheet are shown. The temperatures of FIG. 28 are those when the energy supply pulse width to the heat generating layer is 2 ms, and was obtained by a well-known equation of one-dimensional heat conduction (This applies to the temperatures described hereinafter in conjunction with Graphs. As will be understood from this Figure, inside part of the toner image layer is heated enough to be beyond the minimum fixing temperature so that the image fixing is possible, whereas the inside part of the transfer material is hardly increased in the temperature. It is understood from this that the energy consumption decreases with decrease of the width of the energy supplying pulse width.

In the embodiment, the energy supplying pulse width $\tau$(ms) applied to the heat generating layer satisfies $\tau<1/Vp$.

This means that it is preferable that the energy supplying pulse width $\tau$ is smaller than the time period (1/Vp) required for the transfer material to pass through the effective heating width 1 (microns). Accordingly, in this embodiment, the heat generating layer is linear and integrally formed and is supplied with energy in the form of pulses, so that the temperature increase of the transfer material is constrained, while sufficient heat is assured to effectively and quickly heat and fuse the toner image within the effective width of the linear heat generating portion which is quickly heated in response to the temperature rise of the heating generating element; and further, the unnecessary heating of the toner image is prevented to reduce the energy required for the heating. The energy supplying pulse width is determined so as to accomplish those effects. If the energy supplying pulse width $\tau$ is larger than 1/Vp, and the toner image is sufficiently heated, that portion of the toner image which receives superfluous heating becomes larger so that excessive energy is required. In this case, the temperature rise of the transfer material is large, thus increasing the consumption of the unnecessary energy. Since in the present invention, the energy supplying pulse width $\tau$ is smaller than 1/Vp, the unnecessary heating of the toner image can be avoided, and furthermore, the temperature rise of the transfer material decreases with the decrease of the energy applying pulse width $\tau$, whereby the energy consumption is reduced. The minimum value of the pulse width $\tau$ is determined in accordance with the durable temperature and the durability to the thermal shock of the structural member of the image fixing apparatus such as the heat generating element or member, the fixing film and the like.

The results of experiments will be described. A toner image T was formed with wax toner for a copying machine PPC PC-30 available from Canon Kabushiki Kaisha, Japan. The toner image was pulse-wisely heated for 2 ms for every 10 ms so that $\tau < 1/Vp$ was satisfied and that the amount of heat per one A4 size sheet was approximately 2000 W.S. The image fixing speed was approximately 15 mm/sec. The resultant image does not practically involve any problem. By the energy supply, the heat generating layer was heated up to approximately about 260° C. Since the heat capacity is so small that the temperature decreases during the deenergization period of 8 ms.

Figure 29:
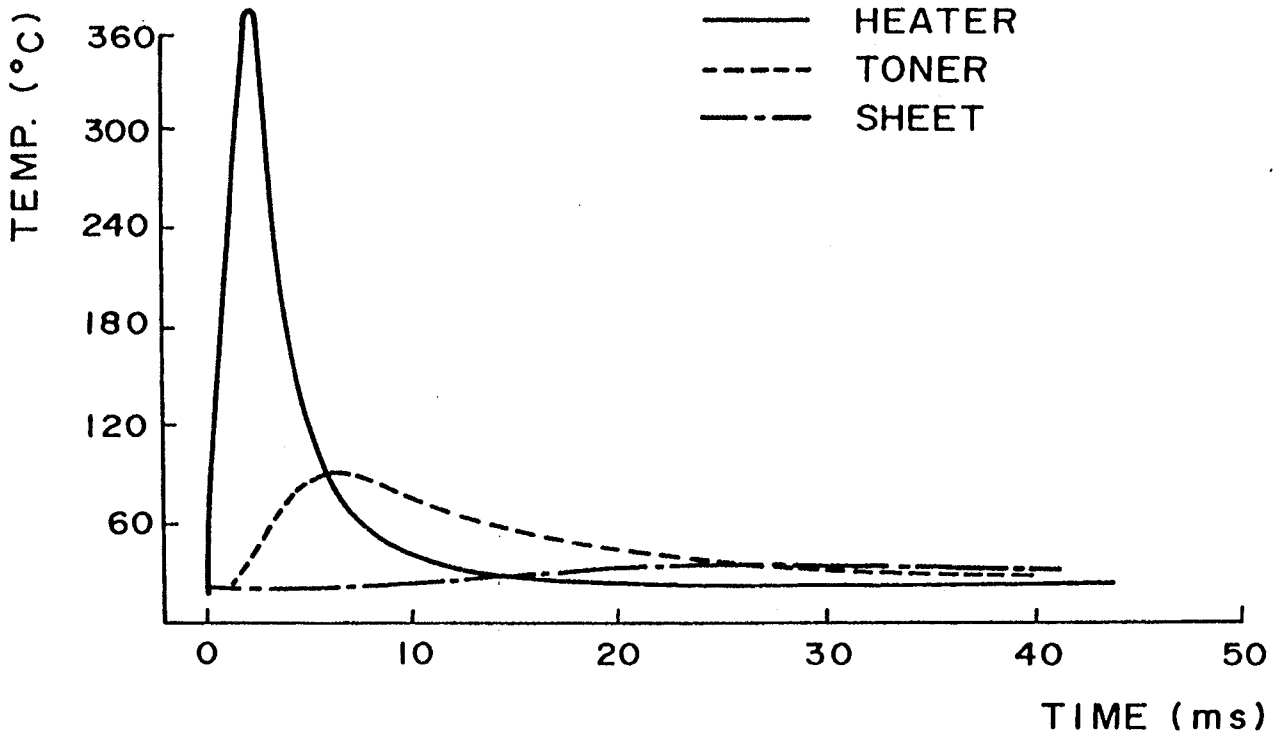
FIG. 29 is a graph illustrating a temperature change with time under operating conditions different from FIG. 28.

Referring to FIG. 29, the results are shown when the same operation was carried out with the apparatus of this embodiment under different conditions, as follows:

Heating conditions: energy density of 32 W/mm$^2$
Heating duration: 2 ms
Toner fixing temperature: 80° C.
Fixing film: polyimide film having a thickness of 25 microns
Thickness of the toner image: 20 microns
Thickness of the transfer sheet: 100 microns
Ambient temperature: 20° C.

In this test, the temperature of the heating portions was increased up to approximately 380° C. which is far higher than the toner fixing temperature which is 80° C., and therefore the toner is sufficiently heated above the toner fixing temperature by the very short heating duration (2 ms). Thus, the image is sufficiently fixed. On the other hand, the temperature rise of the transfer material is very small, and therefore, the wasteful energy consumption is reduced as compared with conventional heat fixing rollers.

The description will be made as to the frequency of the energy supplying pulses. In this embodiment, the frequency $\nu$ of the energy supplying pulses for the heat generating element is determined so as to satisfy:

$$Vp/l \leqq \nu \geqq 2Vp/l$$

This means that when the toner image T being conveyed at a speed Vp is periodically heated within the effective heating width l, each portion of the toner image T is heated at least once, but the same portion is not heated more than twice. Accordingly, in this embodiment, the heat generating layer is linear and integrally formed and is supplied with energy in the form of pulses, so that the temperature increase of the transfer material is constrained, while sufficient heat is assured to effectively and quickly heat and fuse the toner image within the effective width of the linear heat generating portion which is quickly heated in response to the temperature rise of the heating generating element without heating the same portion more than twice; and further, the unnecessary heating of the toner image is prevented to reduce the energy required for the heating. The energy supplying pulse width is determined so as to accomplish those effects.

Results of experiments using an apparatus according to this embodiment will be described. A toner image T was formed with a toner which is softened and fixed at a room temperature which is 20° C. The period (a reciprocal of the frequency) of the pulse energization was 10 ms, and the pulse width was controlled on the basis of the temperature detected by the thermister 55 so that the maximum temperature at the fixing portion (heating portion H) was 300° C. The image fixing speed was approximately 15 mm/sec. The resultant image did not practically involve any problem. According to this embodiment, the heat capacity of the heating portion H is so small that the waiting period having been required to heat the heating portion H by supplying energy to the heat generating element beforehand is not required. In this embodiment, with the increased number of image fixing operations, the temperature of the heating portion H is more or less increased by the heat insulative effect of the insulating layer 53, with the result that the energy supplying pulse width decreases gradually, so that the average power consumption is small. The temperature rise in the apparatus was not a practical problem.

Figure 9:
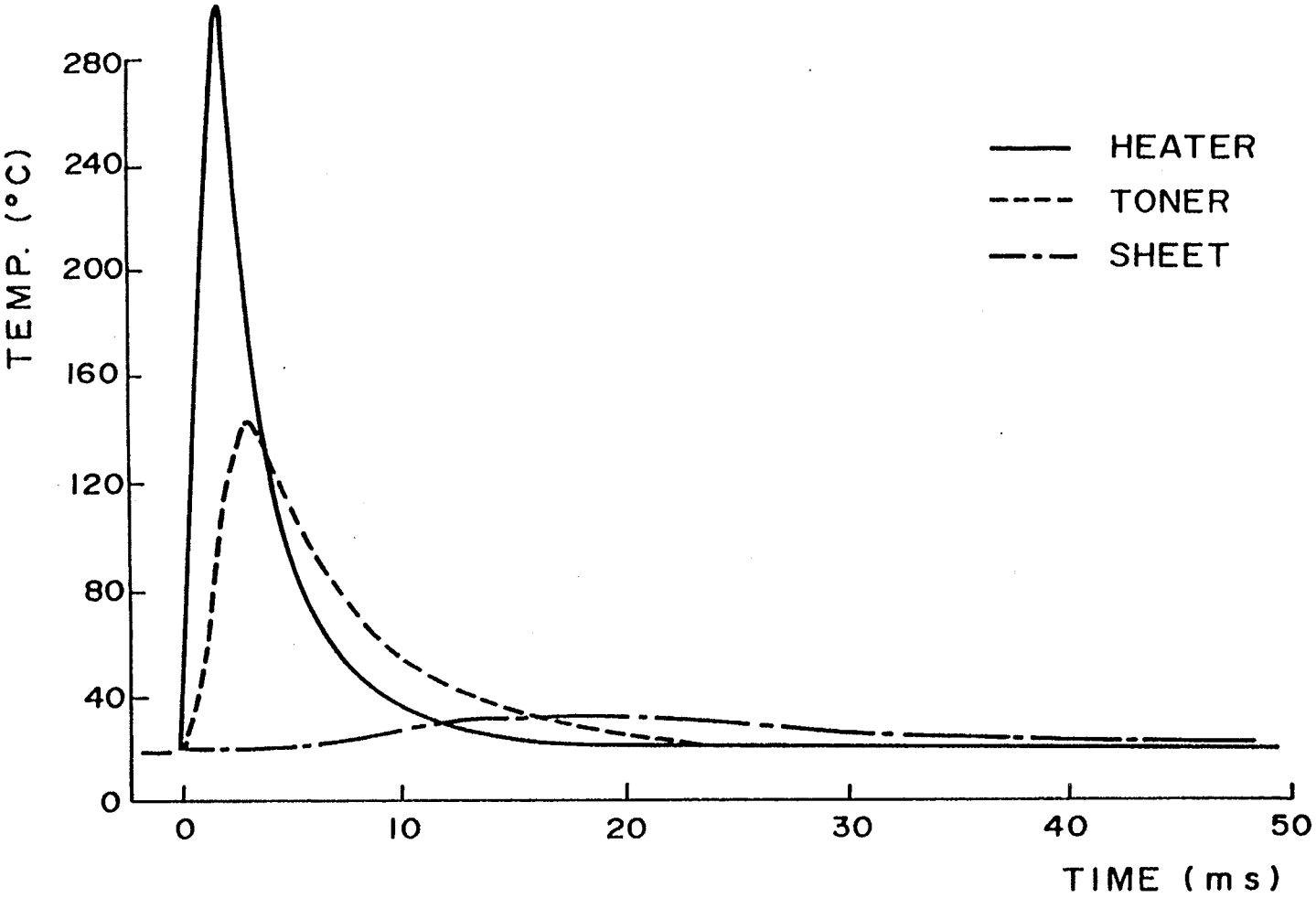

FIG. 9 is a graph showing test results of the temperature changes, with time, of the toner image and the transfer material, more particularly, the temperature at the centers of the thicknesses thereof when the image fixing apparatus according to this embodiment was operated to fix the toner image on the transfer sheet. The conditions were as follows:

Heating condition: energy density of 25 W/mm$^2$
Heating duration: 2 ms
Toner fixing temp.: 125° C.
Fixing sheet: PET (polyethyleneterephthalate) film having a thickness of 6 microns
Thickness of the toner image: 20 microns
Thickness of the transfer sheet: 100 microns
Ambient temperature: 20° C.

In this test, the heating portion H was heated up to approximately 300° C. which was far-higher than the toner fixing temperature which was 125° C., so that the toner was sufficiently heated beyond its fixing temperature, and the resultant fixed image was good. On the other hand, the temperature rise of the transfer material is very small, and the energy is not wastefully consumed as compared with conventional heat fixing rollers.

The reason why the temperature rise of the transfer sheet is small is that the heat capacities of the heat generating layer, protection layer and the heat resistive sheet are very small. The heat generating layer, having a good thermal response property and having a sufficiently small heat capacity, preferably has $10^{-7}$ J/degree.cm$-10^{-2}$ J/degree.cm. In this embodiment, $2\times10^{-6}$ J/degree.cm. The thickness of the layers between the heat generating layer and the toner, that is, the thickness of the protection layer and the heat resistive sheet is not more than 50 microns.

From the results of the test, it is understood that even if excessive energy is applied by variation of the heating duration and a heating energy density, the high temperature offset does not occur, so that the tolerance of the heat control is wide.

In this embodiment, the width of the energy supply pulse to the heat generating element is controlled. However, it is a possible alternative that the voltage of the power supply to the heat generating element is controlled with constant pulse width and the pulse frequency so as to maintain a constant maximum temperature of the heating portion H. When the temperature of the heating portion H is increased from a temperature $T_B$ to a temperature $T_{HO}$ by a pulse energy supply with the voltage of Vo for the period of $\tau_o$, the following relation is satisfied, as described hereinbefore:

$$T_{HO}=To+A\,(1-e^{-B\tau o}) \quad (1)$$

Here, A is generally expressed as $$A=kV^2 \quad (4)$$

in those equations B and k are constants independent from the voltage but determined by the structure and the material of the heat generating element. Then, the following results:

$$T_{HO}=T_B+kV_B2\,(1-e^{-B\tau o})$$

$$V_B=[(T_{HO}-T_B)/[k(1-e^{-B\tau o})]]^{\frac{1}{2}} \quad (5)$$

where $V_B$ is a voltage of the power supply required for the temperature of the heating portion H to be increased from the temperature $T_B$ to the temperature $T_{HO}$ with the pulse energy supply during the period of $\tau_o$.

Therefore, if the constants k and B are determined beforehand by experiments, and $\tau_o$ and $T_{HO}$ are set to be certain values, and the temperature $T_B$ is measured, the heating portion H can be heated up to $T_{HO}$ by applying the voltage $V_B$ determined by equation (5).

According to this embodiment, as contrasted to the foregoing embodiments, the ON/OFF timing of the power supply to the heat generating element is constant, and therefore, the processing by the microcomputer is easier.

As for the position of the thermister 55, it is not limited to the position described in the foregoing. For example, in a part of the protection layer, a heat releasing portion may be formed, where the thermister may be disposed. What is preferable is that the thermister is so positioned that the minimum temperature of the heating portion H can be detected.

Further, it is not necessary to control the energy supplying pulse width for each period $\tau$, but the control is effected at intervals which are longer than the period $\tau$. In that case, the temperature of the heating portion H is not exactly maintained at the temperature $T_{HO}$. However, as described hereinbefore, slight variation of the maximum temperature does not result in an satisfactory fixing performance. What is required is to maintain the temperature of the heating portion H within the temperature range in which practically good image fixing performance can be provided and which includes the temperature $T_{HO}$. On the basis of this condition, the upper limit $\tau_{max}$ of the control timing period, and the control interval is determined within the range between $\tau$ and $\tau_{max}$. Next, the description will be made as to the system wherein the pulse width is controlled.

Figure 10:
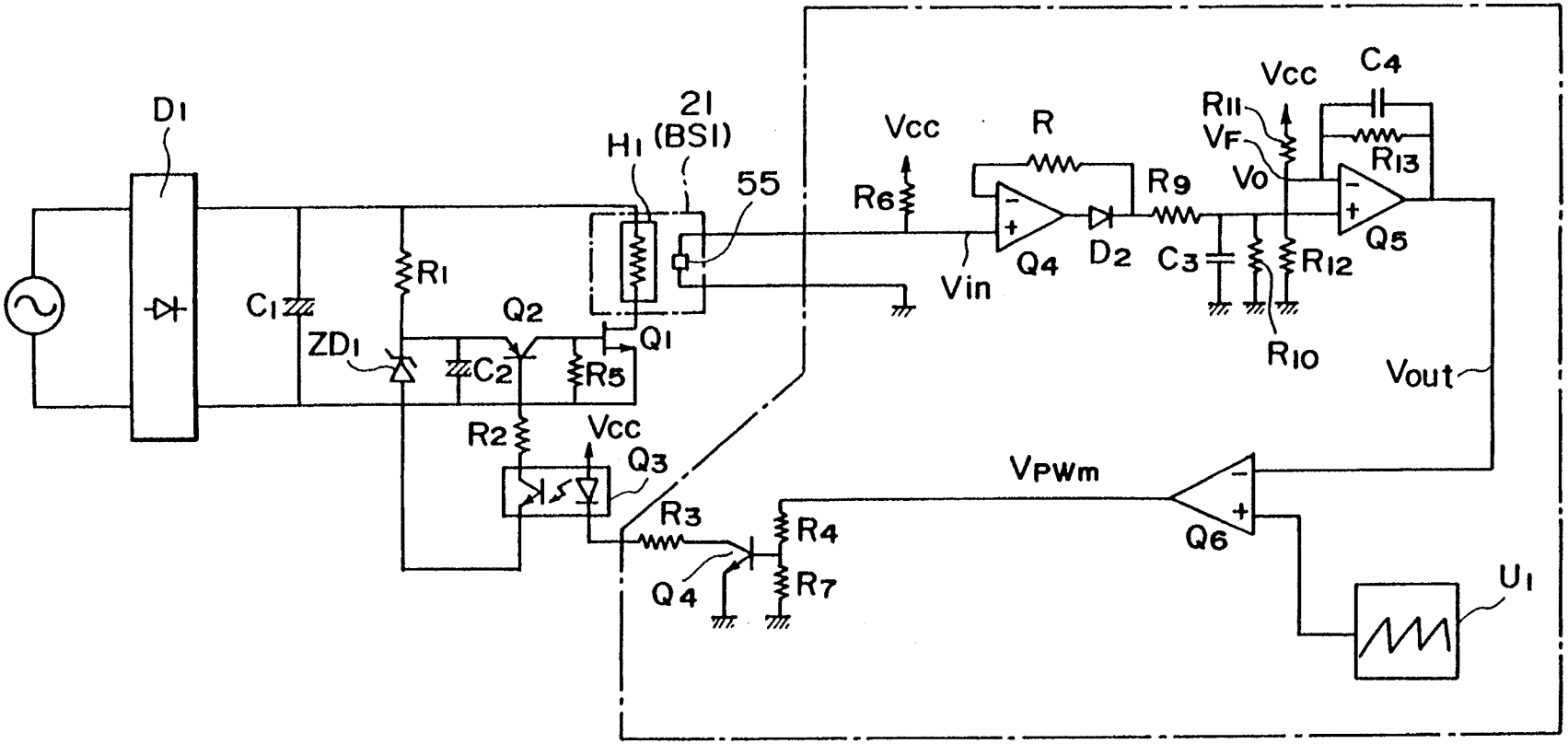
FIG. 10 is a circuit diagram showing a control circuit for controlling energy supply to a heat generating element.

Referring to FIG. 10 there is shown a control circuit in the above described embodiment. The control circuit includes a field effect transistor (FET) Q1 for controlling energization of the heater. The gate of the transistor Q1 is on-off-controlled by a transistor Q2, and the base of the transistor Q2 is controlled by a photocoupler Q3. A light emitting side of the transistor Q3 is on-off-controlled on the basis of a result of feed-back control by a pulse width controlling means U1.

Figure 11:
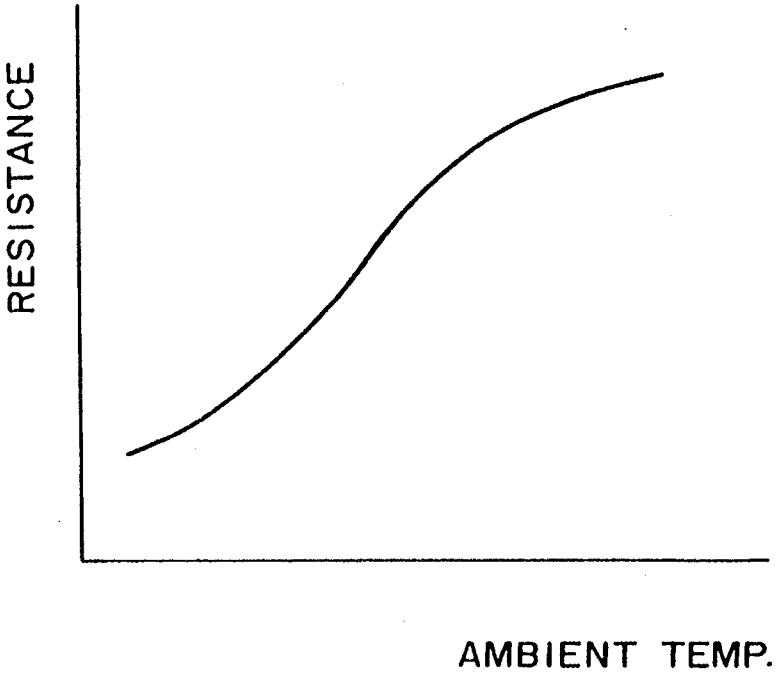
FIGS. 11, 12 and 13 are graphs illustrating temperature changes.

The pulse width control means will be further described. A resistance of the temperature detecting sensor 55 swings at the same frequency as the applied pulse voltage. The coefficient of the resistance change is positive as shown in FIG. 11. As shown in FIG. 10, voltage ratio $V_{IN}$ of the voltage across the resistor R6 and the voltage across the temperature sensor 55, and the relationship between a maximum input voltage Vp to non-reverse input to the operational amplifier Q4 in one pulse and a peak temperature Tp of the heat generating layer is determined beforehand on the basis of tests. Then, the input energy to the heat generating element, that is, the pulse width is controlled so that the voltage Vp is constant (reverse input voltage $V_F$ to an operational amplifier Q5 which will be described hereinafter), by which the peak temperature of the heat generating layer is controlled to be constant.

In FIG. 10, a capacitor C3 is effective to store the above described voltage Vp, and is discharged through a discharging circuit constituted by capacitor C3 and a resistor R10, the discharging circuit having a discharge time constant which is approximately 10 times the pulse period T of control pulses.

Figure 12:
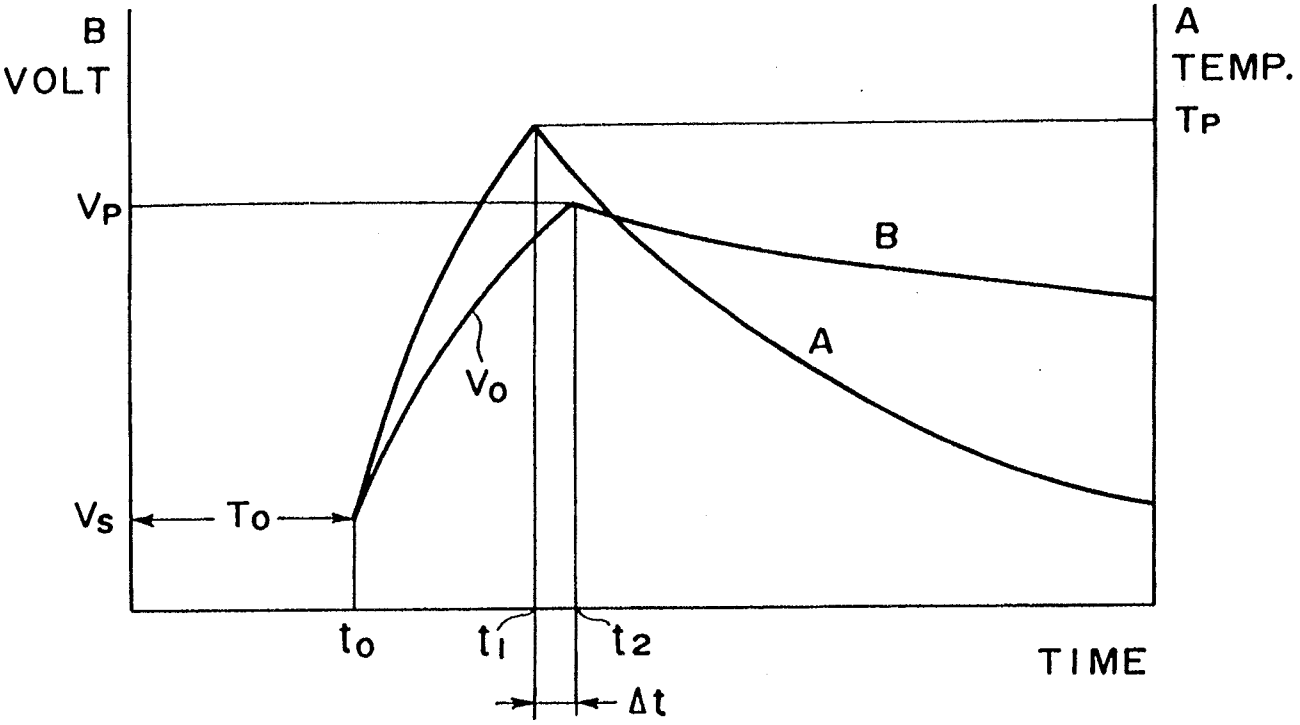

FIG. 12 shows the charging and discharging of the capacitor C3 by a curve B. A curve A indicates the actual temperature of the heat generating layer. As will be understood there is a time difference $\Delta t$ between the actual temperature of the heat generating layer (A) and the output of the temperature sensor TH1. It is considered that this results from the heat transfer therebetween.

Figure 13:
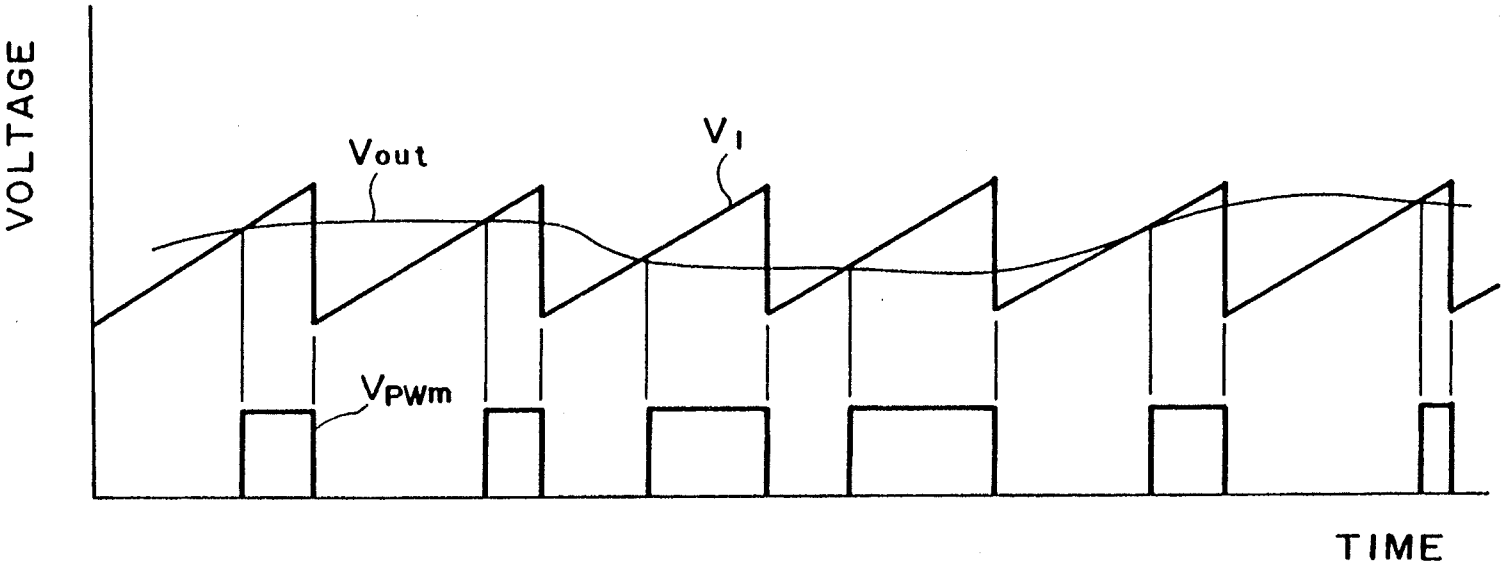

The peak voltage Vp is compared with the reference voltage $V_F$ by a difference amplifier Q5, and the difference is multiplied by G=R13/(R11/R12), and is produced as an output Vout. The output Vout is compared with a reference triangle wave V1 by a comparator Q6, and as a result a PWM output Vpwm is produced. When the peak temperature Tp of the heat generating layer increases so much that the non-reverse input voltage of the difference amplifier exceeds the reference voltage $V_F$ of the reverse input, the output Vout increases, so that the H-level of the PMW output Vpwm becomes shorter, by which the ON duration of the photocoupler 13 is shortened, and ultimately the ON duration of the power FET Q1 is shortened. Thus, the peak temperature Tp of the heat generating layer is corrected toward a lower temperature. On the other hand, when the peak temperature Tp decreases beyond a target temperature, the similar control is effected so as to increase the ON duration of the power field effect transistor Q1. FIG. 13 shows this control.

Figure 14:
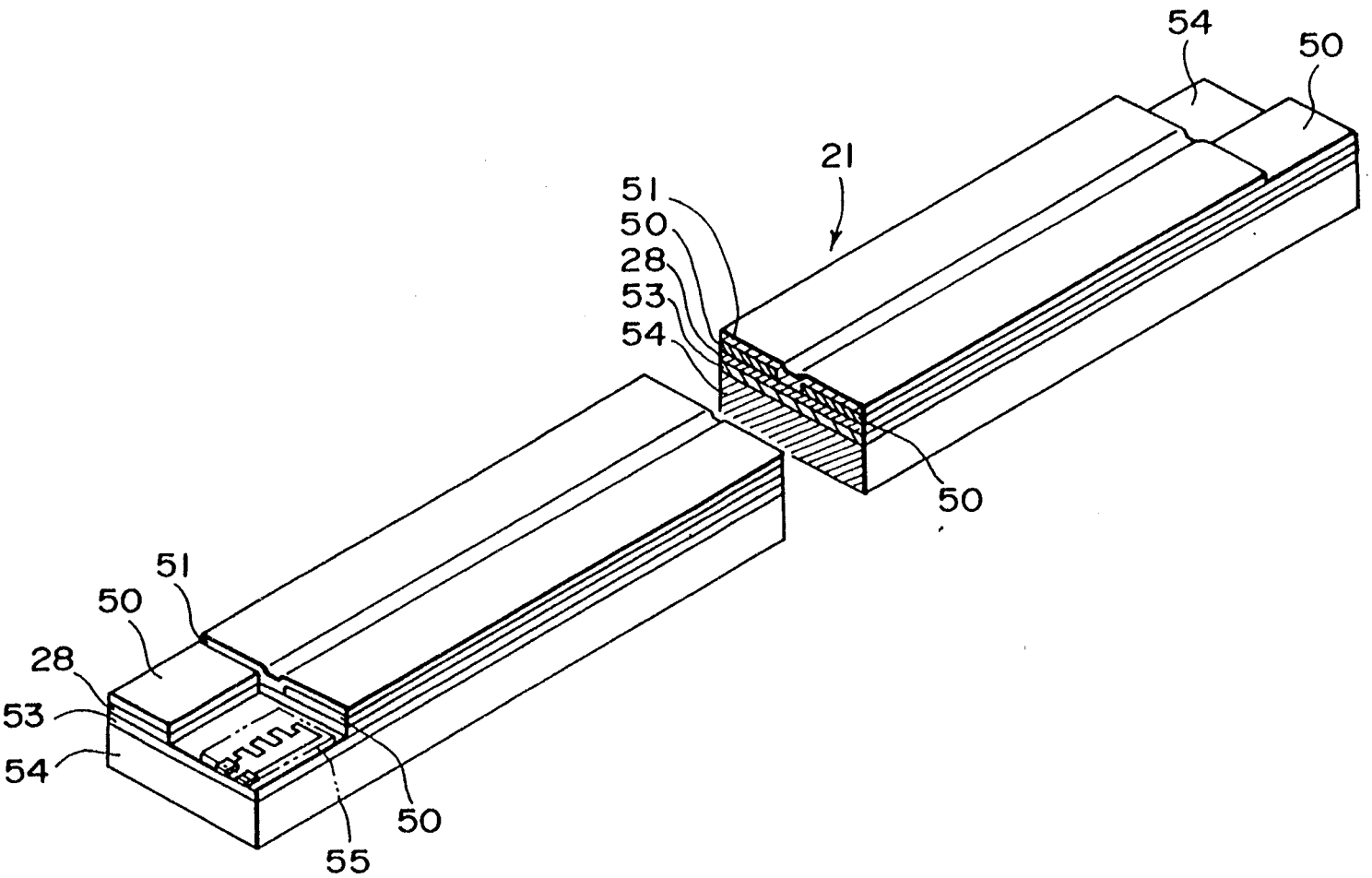
FIG. 14 is a perspective view of a heat generating element which is applicable to an image fixing apparatus according to the embodiments of the present invention.

Referring to FIG. 14 there is shown another example of the heat generating element 21, in which a thermister is mounted on a heat resistive material layer 53. With repetition of the pulse energizations applied to the heat generating layer, the temperature of the heat generating element increases. If the temperature increase becomes large, the toner becomes influenced by the heat of the base layer of the heat generating element.

Figure 15:
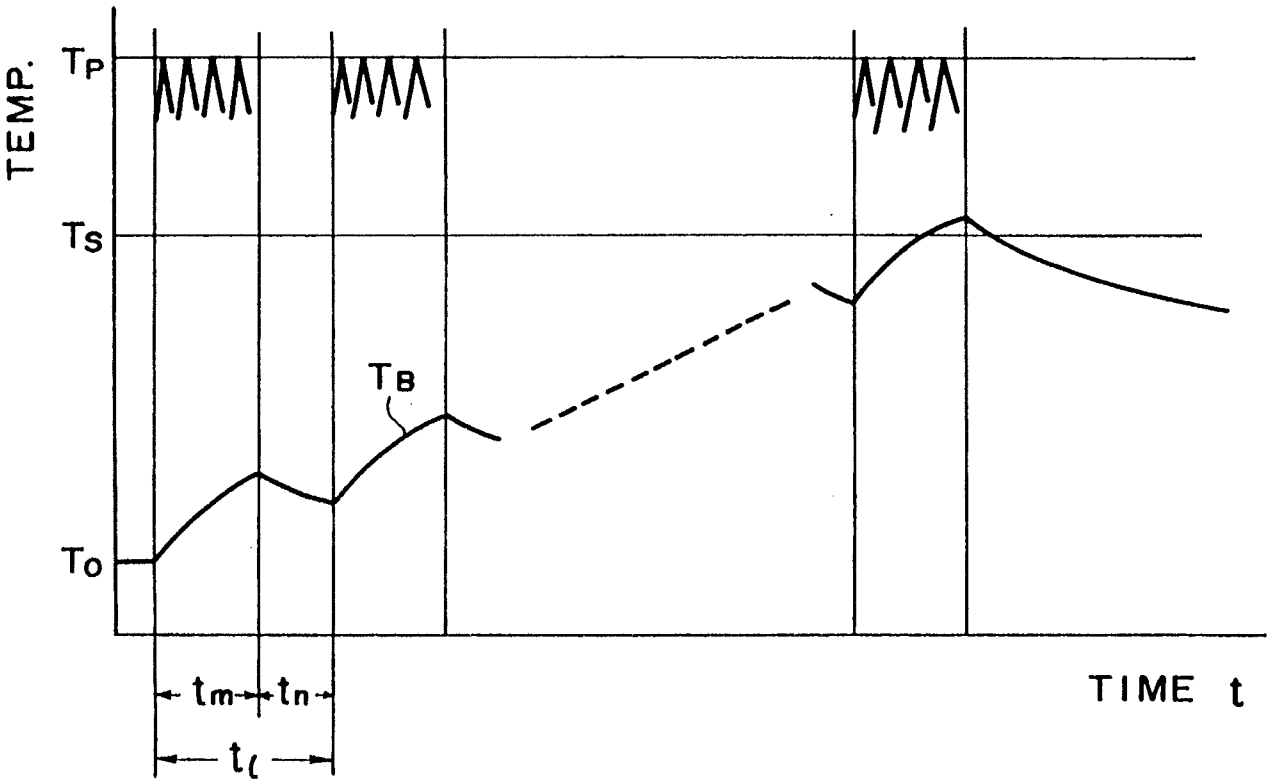
FIGS. 15, 16 and 17 are graphs illustrating a temperature change.

As shown in FIG. 15, it is preferable that if the temperature of the base layer reaches a certain level Ts, the power supply is stopped for a certain duration after the sheet which is being fixed, if any, is discharged, and the image fixing is resumed after the base plate is sufficiently cooled.

In the foregoing, the heat generating layer has been intermittently energized. Next, another type of embodiments will be described. The structure of the image fixing apparatus is the same as the one shown in FIG. 2, and the heat generating element shown in FIG. 6 is used. In response to the detection by the temperature sensor, the energy supply to the heat generating later is controlled so as to maintain the surface temperature of the heating portion of the heat generating element substantially at a constant level.

Figure 16:
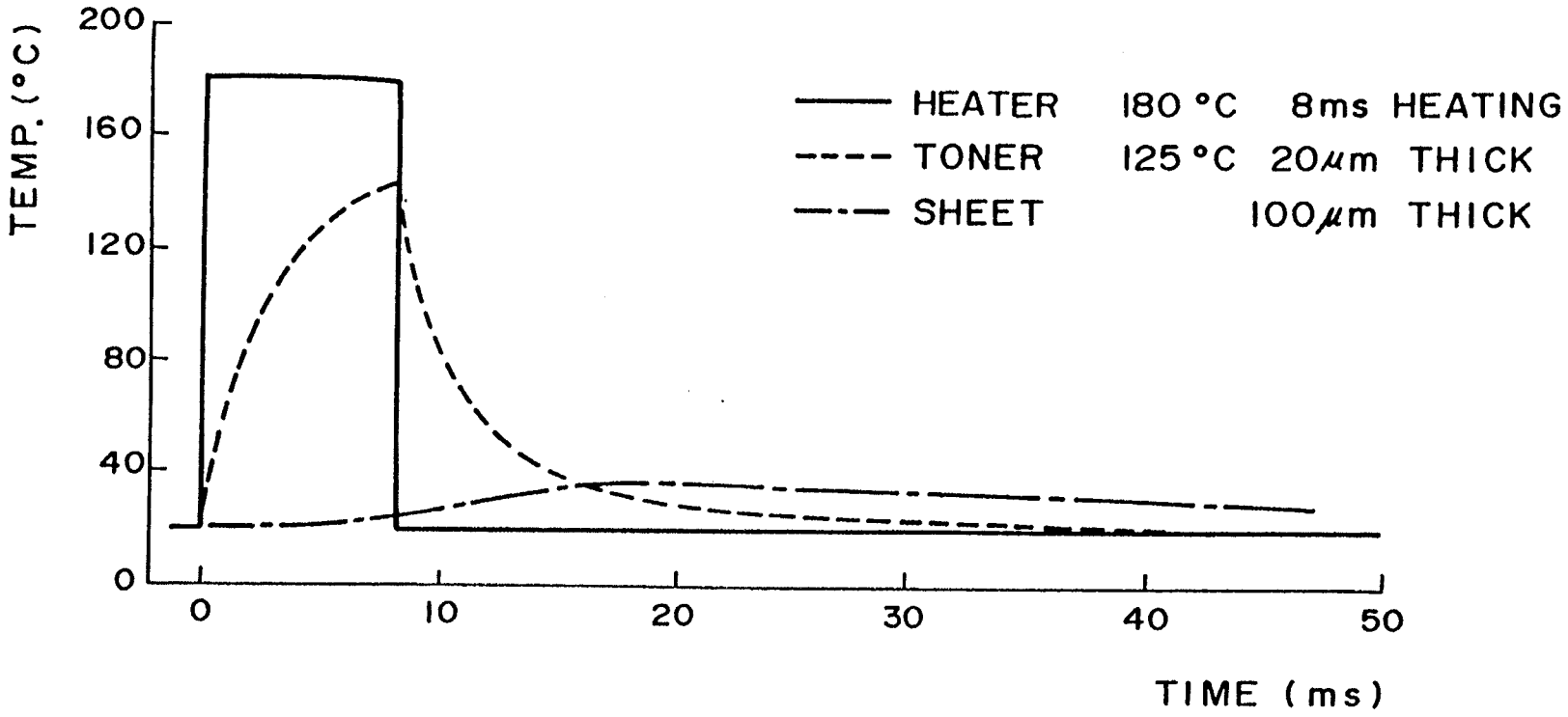

FIG. 16 is a graph showing temperature changes with time for the toner and the transfer sheet (more particularly, the temperatures at the centers of the thicknesses thereof) obtained by calculation.

The fixing conditions were as follows:

Heating condition: heated by a heat generating element having a heating surface maintained at a constant temperature 180° C. for 8 ms while passing by the heat generating layer Toner fixing temperature: 125° C.

Film: PAT base member having a thickness of 6 microns

Toner layer thickness: 20 microns

Transfer sheet thickness: 100 microns

Ambient temperature: 20° C.

According to this embodiment, the heating action is performed by a heating portion maintained at 180° C. which is far higher than the toner fixing temperature 125° C., and therefore the toner is sufficiently heated up to beyond the toner fixing temperature by a short period heating, so that good fixing performance can be provided.

Figure 17:
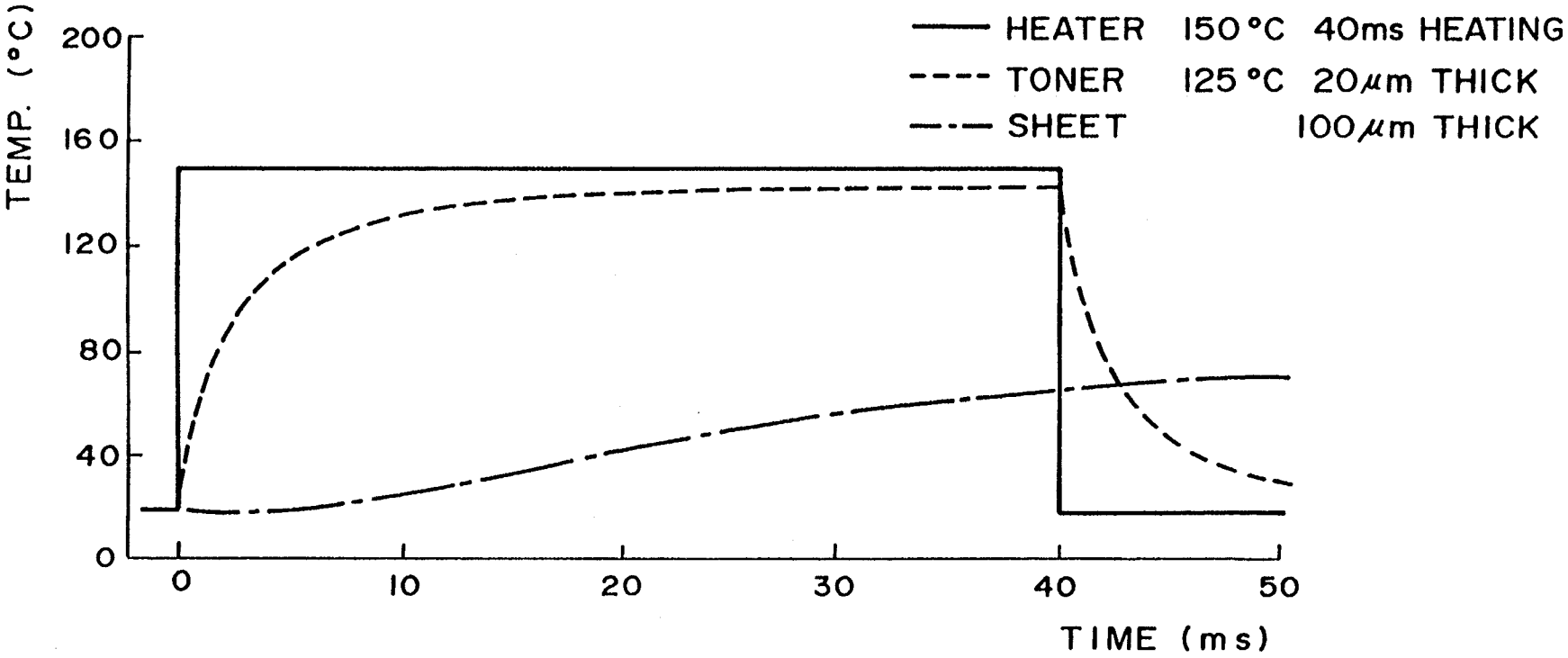

On the other hand, the temperature increase of transfer sheet is very small, and the energy loss is smaller than conventional heating roller fixing. Additionally, even if excessive energy is applied by variation of the heating duration and the temperature of the heat generating element, the high temperature offset does not occur, thus providing a wider latitude. FIG. 17 is a similar graph but with a conventional heating roller type fixing apparatus wherein the image is fixed while the transfer sheet carrying a toner image on the surface thereof being passed through a nip formed between rollers, for the purpose of comparison the fixing conditions were as follows:

Heating condition: heated by a heating roller having a surface maintained at 150° C. for 40 ms while being passed through a nip between the heating roller and a pressing roller Toner fixing temperature: 125° C.

Toner layer thickness: 20 microns

Transfer sheet thickness: 100 microns

Ambient temperature: 20° C.

In the conventional system using the heating roller, if the surface temperature of the fixing roller is significantly higher than the toner fixing temperature, the high temperature offset occurs, that is, the toner is extremely fused and is deposited on the fixing roller. For this reason, the temperature of the fixing roller has to be maintained at a level slightly higher than the toner fixing temperature. Therefore, in the conventional system, as long as 40 ms is required to heat the toner to a temperature providing a sufficient image fixing property. As a result, the heat transfer to the transfer sheet carrying the toner image becomes large, and the transfer sheet is heated up to a very high temperature with large loss of energy. The optimum range of the surface temperature of the fixing roller is narrow, requiring high precision control.

In this embodiment, each of the electrodes 50 is integral and extends in the longitudinal direction of the heat generating element 21, and therefore, it can be supplied with power at a longitudinal end. Also since the heat generating or heating element 21 is stationary, the power supply thereto is extremely easy.

This applies to the case of pulse-wise energization.

In this embodiment, the heat generating element is stationary, and therefore, the temperature sensor 55 may be easily constructed integrally with the heat generating element. Since there is no sliding contact between the temperature sensor and the surface of the heat generating element, deterioration of those elements can be avoided.

Since the heat capacity of the heat generating element is small in this embodiment, the temperature of the heat generating element instantaneously increases with start of energization, and therefore, a long delay inherent to the conventional heating roller type fixing device from the start of energization to the sufficient increase of the surface temperature of the heating element becomes very small, that is, the temperature increasing speed becomes very large.

This applies to the embodiment wherein the heat generating layer is maintained at a constant temperature. More particularly, even if the energization of the heat generating layer 28 starts upon arrival of the transfer sheet P at the transfer material detecting arm 25 disposed upstream of the heat generating element 21 with respect to movement direction of the transfer material P, it is possible without difficulty to increase the surface temperature of the heat generating element to the fixing temperature by the time the transfer material P reaches the heat generating layer 28. Therefore, even if the heat generating layer 28 is not energized when the image forming operation is not performed, the waiting period of the image fixing apparatus is substantially zero. In this manner, the power consumption during non-image-forming period can be decreased, and simultaneously, the temperature rise in the apparatus can be prevented.

Figure 18:
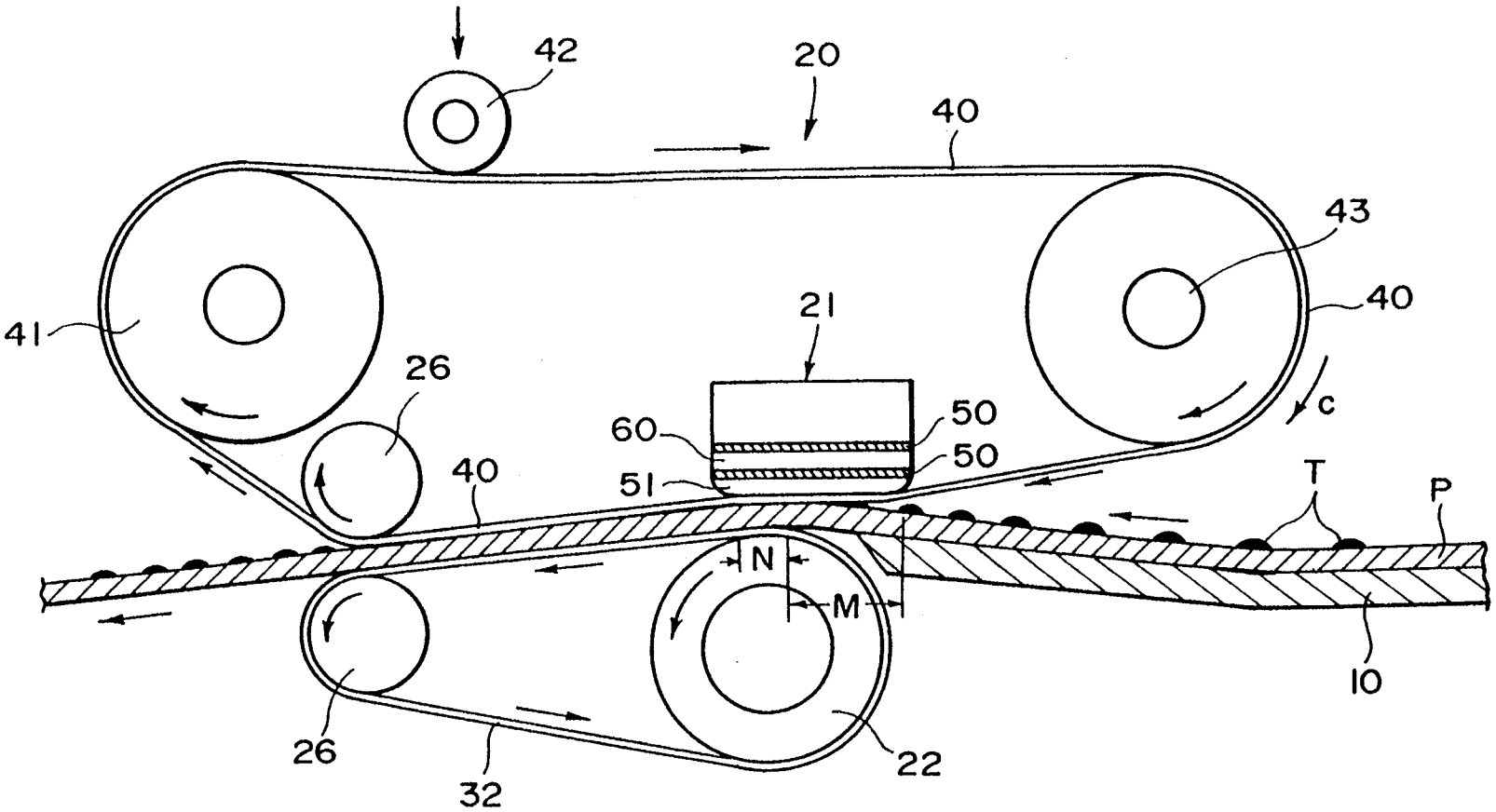
FIG. 18 is a sectional view of an image fixing apparatus according to a yet further embodiment of the present invention.

Referring to FIG. 18, the description will be made as to a further preferable embodiment wherein the heat generating layer is maintained at a constant temperature. In this embodiment, an endless heating resistive sheet 40 is used, which is repeatedly heated and contacted to the toner image layer T. In consideration of the repetitive use, the endless sheet 40 includes a base member made of polyimide resin having a thickness of 25 microns which is excellent in the heat resistivity and mechanical strength, and a parting layer made of fluorine resin or the like showing good parting property on the outer surface of the base member. The endless sheet 40 is driven by a driving shaft 41 to provide a peripheral speed which is the same as the speed of the transfer material. The endless sheet is stretched between the driving shaft 41 and a shaft 43 which is freely rotatable. An idler roller 42 is contacted to the outer surface of the endless sheet 40 to provide tension therein.

In this embodiment, the heat generating layer of the heat generating element 21 is of PTC heat generating material layer 60 such as barium titanate which exhibits a positive coefficient of resistance-temperature. When the resistance layer is energized to produce heat up to about Curie temperature, the resistance rapidly increases with the result of lower heat produced, and therefore, it is self-controlled to a temperature inherent to the material of the resistance layer. By the heat generating element 21, the toner image T is effectively heated in the width N of the nip with the pressing roller 22. In order to obtain durability of the endless sheet 40, the thickness of the sheet is larger than in the embodiment wherein the sheet is not used repetitively. For this reason, the heat transfer from the heat generating element 21 to the toner image is slightly slower. In consideration of this, there is provided a portion M for preheating the endless heat resistive sheet 40 at an inlet side. Therefore, the heating portion of the heat generating element 21 is wider at the inlet side than at the outlet side.

Since the PTC heat generating layer 60 in this embodiment has a little larger heat capacity, so that it is preferably preheated. However, it requires only a few seconds, and therefore, even if the preheating is started simultaneously with image formation, it is sufficiently heated by the time the image fixing operation starts after toner image formation on the transfer sheet. Accordingly, as the image forming apparatus, the waiting period is not necessary or can be reduced.

As described, in this embodiment, the self-temperature control property of the PTC heat generating element eliminates the necessity of temperature detection and power supply control, and the temperature can still be maintained automatically at a constant level.

Figure 19:
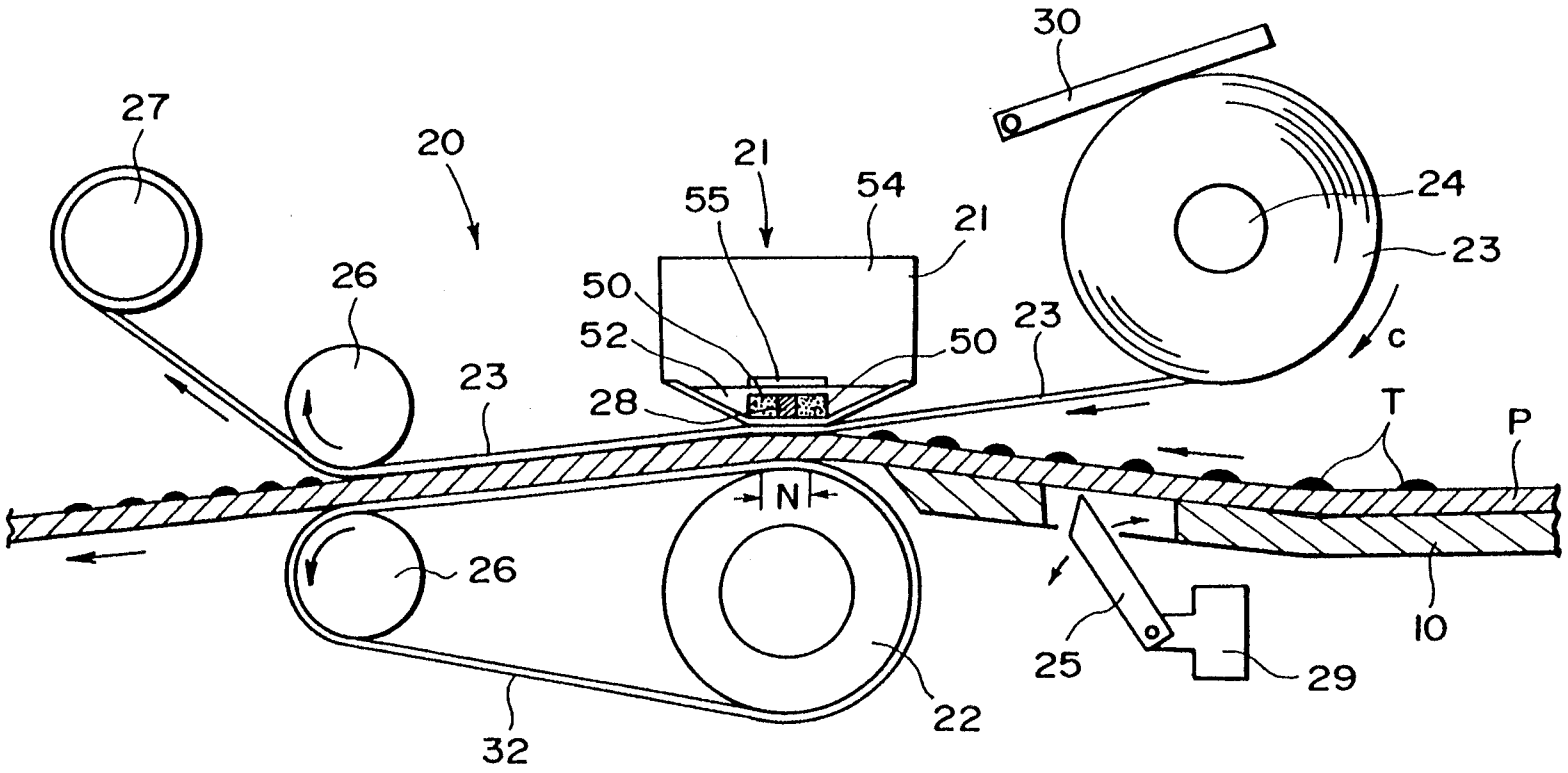
FIG. 19 is a sectional view of an image fixing apparatus according to a yet further embodiment of the present invention.

Referring to FIG. 19, a relationship between the heat generating layer and a nip formed between the heat generating element and the pressing roller.

In this embodiment, the width of the nip N is not uniform along the longitudinal direction, but it is larger adjacent longitudinal ends and smaller in the middle. More particularly, it is 3.5 mm at the longitudinal ends and 3 mm at the center. This is because pressing means for pressing the heat generating element and the pressing roller are provided adjacent the longitudinal ends. On the other hand, the width of the heat generating layer 28 is uniform along the longitudinal direction, and it is smaller than the minimum of the width of the nip N and is sufficiently smaller than a heating width in conventional heating roller type image fixing apparatus, that is, the nip width between the fixing roller and the pressing roller. The heat generating layer 28 is preferably perpendicular to the direction of the transfer material conveyance. However, it may be inclined. Therefore, tolerance of setting the heat generating element during the manufacturing of the apparatus is larger. However, it is preferable that the heat generating element extends within the width of the nip between itself and the pressing roller at least within the range in which the transfer sheet is passed.

The effective heating width is the width of the heat generating layer 28 which is smaller than the width of the nip N and is uniform along the length of the heat generating element 21. Therefore, during the image fixing operation, the heating duration is uniform along the length of the heat generating element 21, and therefore, the good fixing property can be provided all over the surface of the transfer material P without toner offset.

Figure 20:
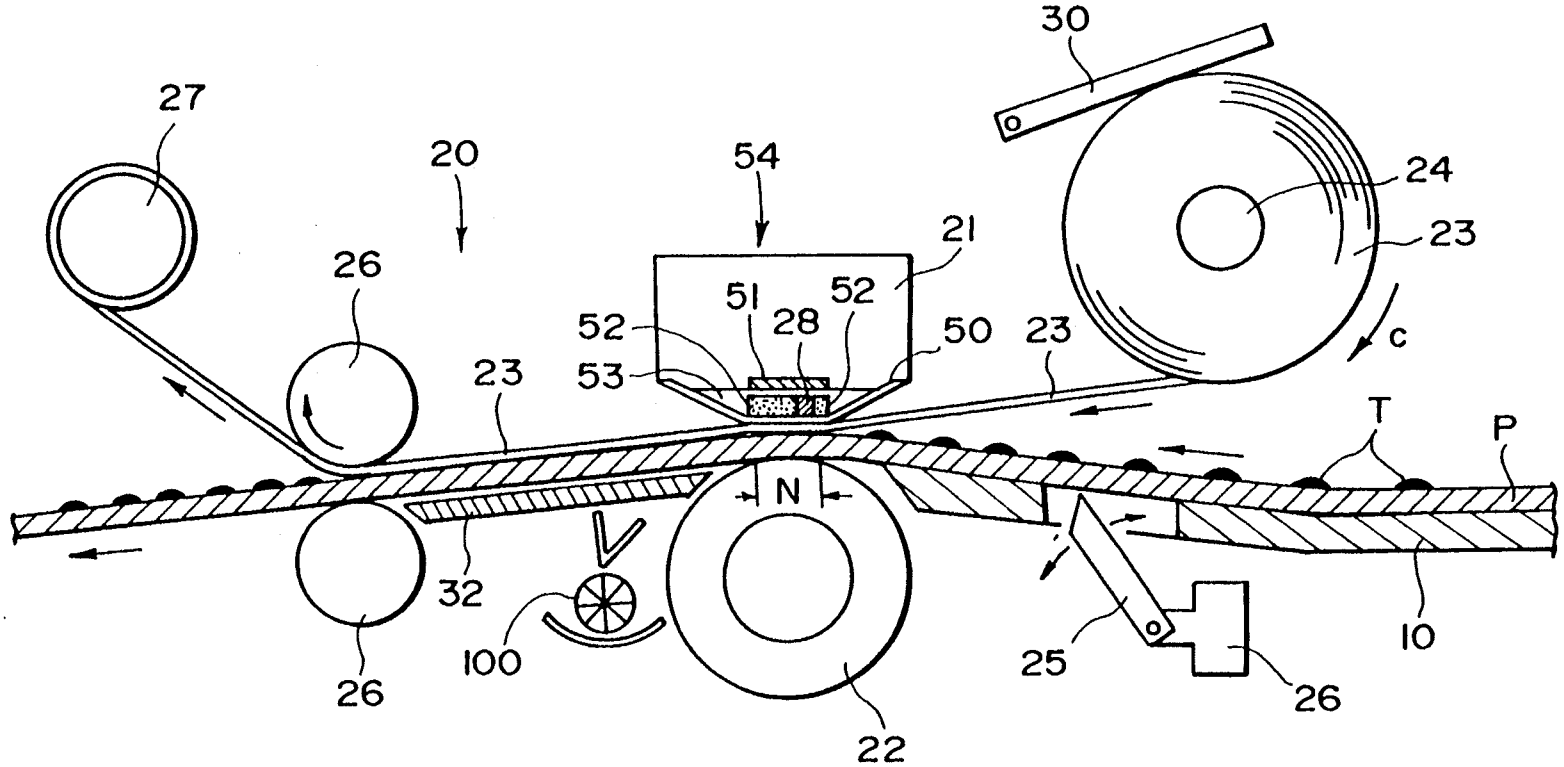
FIG. 20 is a sectional view of an image fixing apparatus according to a yet further embodiment of the present invention.

Referring to FIG. 20, a further embodiment will be described wherein, similarly to FIG. 19 embodiment, the width of the nip N is not uniform but is large at the longitudinal end and small in the middle. More particularly, it is 3.5 mm at the longitudinal ends and 3 mm at the center. This is because pressing means for pressing the heat generating element and the pressing roller is provided adjacent longitudinal ends. On the other hand, the width of the heat generating layer 28 is uniform along the length of the heat generating element 21 and is smaller than the minimum width of the nip N and is sufficiently smaller than the heating width in conventional heating roller type image fixing apparatus, that is, the nip width between image fixing roller and the pressing roller. The heat generating layer 28 is preferably perpendicular to the direction of the transfer material conveyance. However, it may be inclined. Therefore, tolerance of setting the heat generating element during the manufacturing of the apparatus is larger. However, it is preferable that the heat generating element extends within the width of the nip between itself and the pressing roller at least within the range in which the transfer sheet is passed.

The center of the heat generating layer 28 as seen in FIG. 20 is deviated from the center of the nip toward an inlet of the transfer material to the image fixing apparatus, by which the toner image is not heated at the outlet side of the nip.

Because the heat capacity of the pressing roller is large, and because the diameter thereof is large, the surface of the pressing roller is maintained at a temperature lower than the toner fusing temperature. The apparatus of this embodiment is provided with a cross-flow form 100 to apply air flow to the pressing roller 22 during fixing operation to further suppress the possible temperature rise of the pressing roller 22.

Since the temperature rise of the pressing roller 22 is suppressed in this manner, the heat of the toner image is radiated, by deviation the heating position toward the transfer material inlet.

By doing so, the time required for the toner image to be cooled and solidified can be reduced, and therefore, the distance between the heat generating element 21 and the separating roller 26 can be reduced. This contributes to reducing the size of the apparatus.

In order to reduce or eliminate the toner offset to the heat resistive sheet, it is preferable that the sheet is contacted to the toner image on the transfer material under pressure after the toner image is heated and fused in the nip N and before the separating roller 26. Particularly, the viscosity of the toner is low immediately after a cooling step starts after the heating step, and if the heat resistive sheet is separated from the toner image on the transfer material with such a state, the offset can occur. In this embodiment, the toner image heated and fused can be assuredly cooled and solidified while being pressed to the heat resistive sheet at the outlet portion of the nip N, and therefore, the offset problem does not arise.

The description will be made as to the heat resistive sheet.

The sheet 23 or 40 is required to be strong and heat resistive enough. As for a material satisfying this, there is a polyimide film, for example. However, the polyimide film does not have good parting property with respect to toner with the result of a slight offset of the toner. A preferable heat resistive sheet will be described.

EXAMPLE 1

Figure 21:
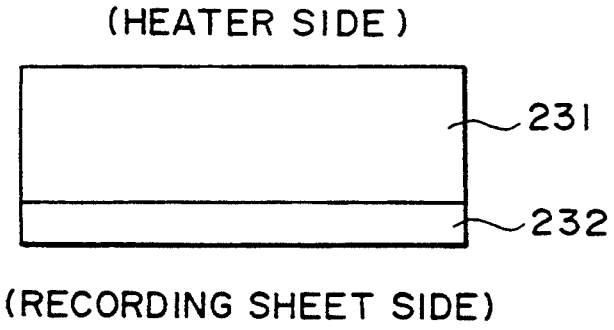
FIGS. 21, 22, 23, 24 and 25 are sectional views of a sheet material usable with an image fixing apparatus according to the embodiments of the present invention.

FIG. 21 shows a sectional view of a first example of the heat resistive sheet wherein the heat resistive sheet includes a plurality of layers 231 and 232.

The layer 231 is a base layer which is mechanically strong and heat resistive and which is made of a polyimide film having a thickness of 9 microns. The upper surface of the polyimide film is contacted to the heat generating element 21. On the bottom surface of the heat resistive base layer made of polyimide, a parting layer 232 made of PTFE (polytetrafluoroethylene) having a thickness of 3.5 microns is provided, and the parting layer 232 is contacted to the toner toner.

The sheet is produced in the following manner. A mixture of PTFE particles having an average particle size of 0.1 micron and a surface active agent for producing coagulation of the PTFE particles is uniformly applied on the surface of the heat resistive base layer 231, and is air-dried for one hour at 60° C., and then sintered for 20 minutes at 350° C. During the sintering, the parting layer of PTFE is heat-shrinked to curl the sheet. To reduce the influence of the curling, the thickness of the base layer 231 is preferably larger than the thickness of the parting layer 232.

Thus, by employing a multi-layer structure rather than a single layer structure, more particularly, the multi-layer structure including at least a base layer having high strength and heat resistivity and a parting layer having good parting property, the sheet acquires sufficient durability and parting property. As for the material for the parting layer small surface energy materials are usable. Among them, fluorine resin such as PTFE and PFA (perfluoroalkoxy) resin, and silicone resin are preferable. As for the other material for the base layer 231, there are highly heat resistive resins such as polyether etherketone (PEEK), polyethersulfone (FES) and polyetherimide (PEI), and metal such as nickel, stainless steel and aluminum, which are strong and heat resistive enough.

The parting layer may be applied by electrostatic painting or the like, or may be formed by filming technique such as evaporation and CVD.

Comparison Example 1

When a sheet made only of polyimide was used, a slight amount of toner was offset to the sheet even if the recording material is separated after the toner was cooled. This is because the surface energy of the polyimide is large.

Comparison Example 2

When a sheet made only of a fluorine resin such as PFA and PTFE was used, the sheet was heat-shrinked by the heating by the heat generating element. Also, the sheet was quickly worn, and therefore, was not durable enough. This is considered to be because the sheet is slit relatively to the heat generating element under a heated condition.

Figure 22:
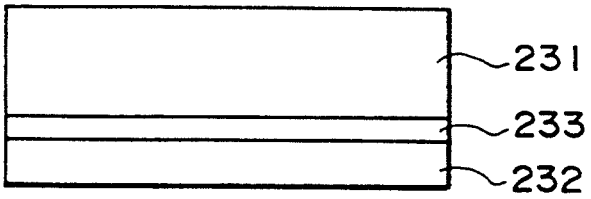

EXAMPLE 2

Where the sheet is multi-layer construction, the layers are liable to be peeled, if the adhesion between the layers is not enough. Referring to FIG. 22, the sheet of this example includes a bonding layer 233 made of a fluorine resin between the base layer 231 and the parting layer 232. By the provision of the bonding layer, the adhesion between the base layer and the parting layer is enhanced, and therefore, the durability of the sheet is further improved.

EXAMPLE 3

As described, the provision of the bonding layer is effective to enhance the adhesion between the layers. From the standpoint of good thermal response, however, it is not desirable that the heat capacity of the sheet is increased. This is particularly so, when the heat generating element is pulse-wisely energized.

Figure 23:
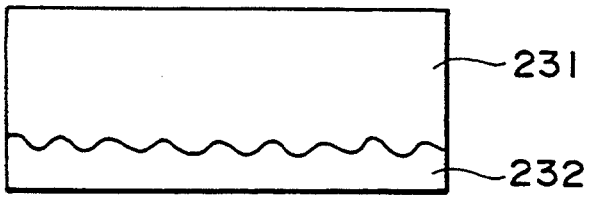

Referring to FIG. 23, this example is such that the adhesion between the base layer 231 and the parting layer 232 is improved without the provision of the bonding layer. The surface of the base layer 231 is roughened, and the toughened layer is coated with the parting layer 232. Because the sheet of this example is not provided with the bonding layer, the heat capacity of the sheet is not increased. This example is particularly preferable when the heat generating element is pulsewisely energized and heated.

EXAMPLE 4

In this example, the base polyimide film layer is provided with a laminated fluorine resin film as the parting layer 52. Between the polyimide film and the fluorine resin film a bonding layer 233 may be provided, as shown in FIG. 23.

Since the fluorine resin film has a good surface smoothness, and therefore, good offset preventing effect, and also since it provides the parting layer having good mechanical strength, it is preferable in the case where the fixing speed is low and/or where the amount of heat generated by the heat generating element is large.

EXAMPLE 5

Figure 24:
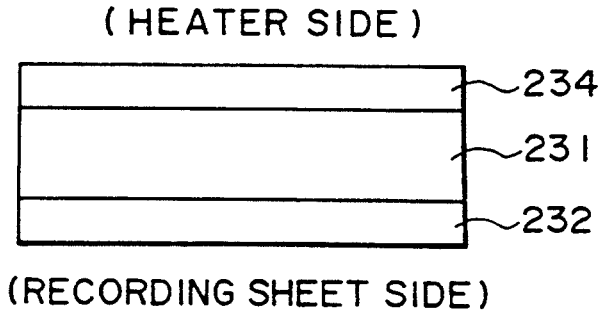

Referring to FIG. 24, the base layer 231 in this example is provided with a sliding layer 234 at its heat generating element side, the sliding layer 234 providing good slidability.

By this structure, the frictional resistance between the sheet and the heat generating element can be reduced so that the driving force for the sheet can be decreased and that the movement of the sheet is stabilized. Therefore, this example is particularly preferable when the sheet slides on the heat generating element.

EXAMPLE 6

Figure 25:
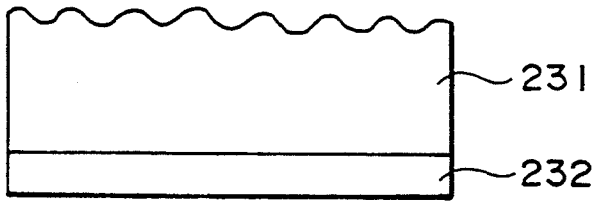

Referring to FIG. 25, an example is shown wherein the frictional resistance between the sheet and the heat generating element is reduced without increasing the heat capacity of the sheet. In this example, that surface of the sheet which are contacted with the heat generating element is roughened to reduce the actual area of contact between the sheet and the heat generating element.

EXAMPLE 7

In this example, the parting layer 232 and/or the sliding layer 234 contains a high hardness material such as titanium oxide and titanium nitride.

This is preferable when the parting layer 232 and/or the sliding layer 234 requires high hardness.

According to the examples described above, the mechanical strength and the thermal durability of the entire sheet are assured by the base layer 231, and simultaneously, the parting property from the toner is assured by the provision of the parting layer 232, whereby the durability and the offset preventing effect can be provided.

In the case where a highly heat resistive resin material is used such as polyimide for the base layer, the sheet tends to be electrically charged with the result of disturbance to the unfixed toner image upon image fixing operation, or electrostatic attraction of the toner image to the sheet, by which the above described good offset preventing effect can be disturbed.

Examples of the sheet which can prevent the electrical charging thereof will be described. In those examples, the electric resistance of the surface layer except for the base layer, particularly, at least the parting layer 232 is reduced.

EXAMPLE 8

In this example, the parting layer 232 is made of PTFE layer in which carbon black is dispersed, by which the volume resistivity of the PTFE layer is reduced down to $10^8$ ohm.cm.

By this reduction of the resistivity, the electric charging of the sheet is prevented, whereby the disturbance of the unfixed image due to the electrostatic force can be prevented. The electrostatic charging can result in attraction of dust by the sheet which reads to decrease of the parting property and damage to a pressing roller 22.

These problems can be solved in this example.

In the case where the sheet is not of the endless type, but is a take-up type as shown in FIG. 4, and it is reused, the electric charge on such a surface thereof as not contains the low resistivity material is removed when it is contacted to the other surface containing the low resistivity material. In other words, the charge preventing effect of a certain degree can be provided by containing the low resistivity material only at one of the surface. However, it is preferable that the material is contained at both of the surfaces.

When the sheet is slid on the heat generating element, it is possible that surface of the sheet contacted to the heat generating element is so charged that dust is present between the stationary heat generating element 21 and the sheet, which can result in damage of the heat generating element and the sheet. This example can solve this problem.

Further, in order to ensure the charge prevention on both sides of the sheet, it is preferable that resistances of both of the surface layers of the sheet. More particularly, an additional layer is provided on the heat generating element side of the base layer of the sheet, as shown in FIG. 24, and the resistivity of this layer is decreased.

It is possible that a low resistance filler material such as carbon black is mixed directly into the base layer. However, it is preferable not to do so, since then heat resistivity and the strength of the base layer are reduced.

A sufficient charge preventing effect was provided by reducing the volume resistivity of the low resistivity layer down to not more than $10^{11}$ ohm.cm. Further preferably, the charge preventing effect was assured by reducing it down to more than $10^9$ ohm.cm.

As another example of the low resistivity filler material, there are titanium nitride, potassium titanate, red iron oxide or the like.

Comparison Example 3

The parting layer 232 and the sliding layer 234 of the sheet were made of PTFE coating layers without the low resistivity material such as carbon black and having the volume resistivity of not less than $10^{15}$ ohm/cm. When the image fixing operation was repeated using this sheet, dust sometimes was attached to the sheet, and the unfixed image on the recording material was sometimes disturbed. The reasons are considered to be as follows:

(1) Electric discharging by the separation of the sheet from the recording or transfer material by the separation roller 26:

(2) Electric discharging caused by unwinding the sheet from the reel shaft 24: and (3) Triboelectric discharging by the friction between the sheet and the heat generating layer 21.

EXAMPLE 9

In this example, as the low resistivity filler material, titanium oxide wisker which is monocrystal fibers having electric conductivity (volume resistivity of $10^4$ ohm.cm).

The conductive wisker is preferable because it has the charge preventing effect and is excellent in hardness, so that the wearing is further reduced, and the durability of the sheet is further improved.

EXAMPLE 10

Figure 26:
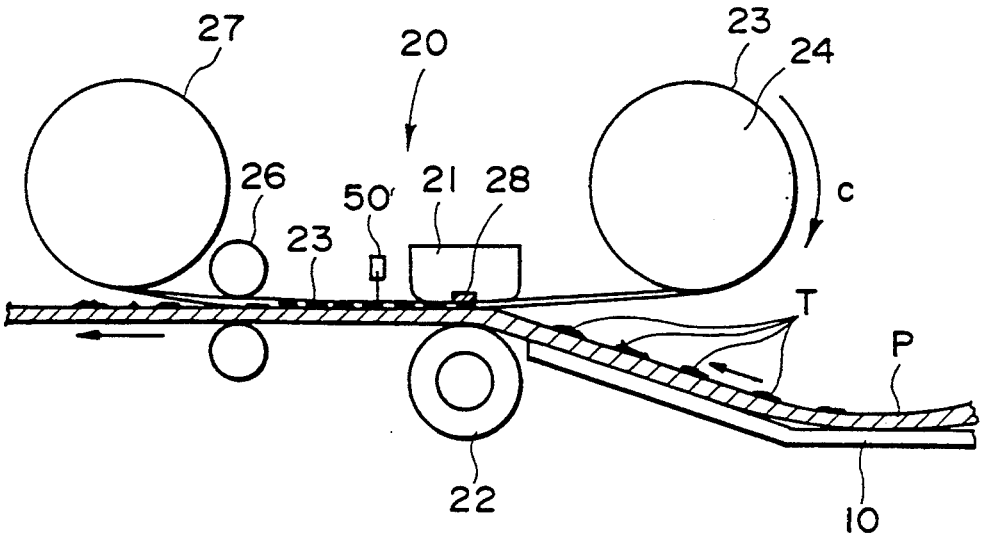
FIG. 26 is a sectional view of an image fixing apparatus according to a yet further embodiment of the present invention.

Referring to FIG. 26, charge removing means 50 and 51 for removing electric charge from the sheet, which, for example, is a discharging brush of carbon fibers, are contacted to the sheet of Example 1. The charge preventing effect was further improved, and the good charge preventing effect can be provided even if the amount of the low resistivity filler is reduced. The charge removing means may be provided to both sides of the sheet or to one side thereof. The charge removing function can be provided by making the supply and take-up reels 24 and 27 from a conductive material such as metal or the like.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an accommodator for accommodating a recording material;

means for forming a visualized image on the recording material supplied from said accommodator;

fixing means for heating and fixing the visualized image, said fixing means including each of (i) a heat generating resistor layer, (ii) a protection layer covering said heat generating resistor layer, and (iii) a sheet movable with the recording material in sliding contact with said protection layer, wherein the visualized image is heated by heat from said heat generating resistor layer through said sheet;

a position detector for detecting a position of the recording material; and power supply means for starting power supply to said heat generating resistor layer in accordance with an output of said position detector.

2. An apparatus according to claim 1, wherein said position detector detects that a leading edge of the recording material reaches a position between said accommodator and said fixing means.

* * * * *

UNITED STATES PATENT AND TRADEMARK OFFICE

CERTIFICATE OF CORRECTION

PATENT NO. : 5,343,280

DATED : August 30, 1994

INVENTOR(S) : HIROMITSU HIRABAYASHI, ET AL.

It is certified that error appears in the above-indentified patent and that said Letters Patent is hereby corrected as shown below:

On the title page, item [57]: Abstract,
line 10, "heater" should read --a heater--.

Column 1,
line 39, "soften" should read --softened--.

Column 2,
line 57, "an" should read --a--.

Column 6,
line 49, "conforta-" should read --comforta- --,

Column 9,
line 47, "tempolarily rise" should read --temporarily rises--.

Column 11,
line 13, "soften" should read --softened--;
line 33, " $_{\beta}$" should read --$T_{\beta}$--;
line 57, "electrode" should read --electrodes--; and
line 61, "electrode" should read --electrodes--.

Column 15,
line 30, "equations" should read --equations,--; and
line 37, "$V_{\beta}=[(T_{HO}-T_{\beta})/[k(1-e^{-\beta\tau o})]^{1/2}$.....(5)" should read --$V_{\beta}=[(T_{HO}-T_{\beta})/\{k(1-e^{-\beta\tau o})\}]^{1/2}$.....(5)--; and
line 66, "an" should read --a--.

UNITED STATES PATENT AND TRADEMARK OFFICE

CERTIFICATE OF CORRECTION

PATENT NO. : 5,343,280

DATED : August 30, 1994

INVENTOR(S) : HIROMITSU HIRABAYASHI, ET AL.

It is certified that error appears in the above-indentified patent and that said Letters Patent is hereby corrected as shown below:

Column 17,
line 17, "ments" should read --ment--.

Column 21,
line 23, "toner toner." should read --toner.--.

Column 22,
line 64, "are" should read --is--.

Column 23,
line 37, "reads" should read --leads--; and
line 49, "surface." should read --surfaces.--.

Signed and Sealed this

Seventh Day of February, 1995

Bruce Lehman

*Attest:*

BRUCE LEHMAN

*Attesting Officer*

*Commissioner of Patents and Trademarks*

--